US010586422B2

(12) United States Patent
Arnone et al.

(10) Patent No.: US 10,586,422 B2
(45) **Date of Patent: *Mar. 10, 2020**

(54) HYBRID GAMING SYSTEM HAVING OMNISCIENCE GAMBLING PROPOSITION

(71) Applicant: Gamblit Gaming, LLC, Glendale, CA (US)

(72) Inventors: Miles Arnone, Sherborn, MA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,492

(22) Filed: Feb. 26, 2019

(65) Prior Publication Data

US 2019/0197823 A1 Jun. 27, 2019

Related U.S. Application Data

(63) Continuation of application No. 15/882,333, filed on Jan. 29, 2018, now Pat. No. 10,223,863, which is a continuation of application No. 14/586,639, filed on Dec. 30, 2014, now Pat. No. 9,881,446, which is a continuation of application No. PCT/US2013/048986, filed on Jul. 1, 2013.

(60) Provisional application No. 61/666,865, filed on Jun. 30, 2012.

(51) Int. Cl.
*G07F 17/32* (2006.01)

(52) U.S. Cl.
CPC ..... *G07F 17/3225* (2013.01); *G07F 17/326* (2013.01); *G07F 17/3244* (2013.01); *G07F 17/3267* (2013.01); *G07F 17/3288* (2013.01)

(58) Field of Classification Search
CPC . G07F 17/326; G07F 17/3267; G07F 17/3269
USPC ..... 463/16–20, 25
See application file for complete search history.

(56) References Cited

U.S. PATENT DOCUMENTS 5,413,357 A * 5/1995 Schulze ..... A63F 9/0291 463/23
5,718,429 A * 2/1998 Keller, Jr. ..... A63F 3/00157 273/274
5,785,592 A * 7/1998 Jacobsen ..... A63F 9/0291 273/349
5,853,324 A * 12/1998 Kami ..... A63F 13/005 463/2
5,963,745 A * 10/1999 Collins ..... G06F 9/3838 712/10
6,050,895 A * 4/2000 Luciano, Jr. ..... G07F 17/32 463/20
6,165,071 A * 12/2000 Weiss ..... G07F 17/32 463/16
6,227,974 B1 * 5/2001 Eilat ..... A63F 13/005 273/148 B (Continued)

*Primary Examiner* — Michael A Cuff
(74) *Attorney, Agent, or Firm* — Frank Cire

(57) ABSTRACT

Systems and methods for providing a gambling hybrid game having an omniscience mode are disclosed. The systems and method involve receiving an input from a player accepting an omniscience gambling proposition. The results of a gambling event associated with the omniscience gambling proposition are then determined and wagers are resolved. The results of the gambling event are then used to determine information to provide a player to satisfy the omniscience gambling proposition.

10 Claims, 18 Drawing Sheets

(56) References Cited

U.S. PATENT DOCUMENTS 6,267,669 B1 * 7/2001 Luciano, Jr. ..... A63F 13/10 273/269
6,302,791 B1 * 10/2001 Frohm ..... G07F 17/3244 273/143 R
6,685,563 B1 * 2/2004 Meekins ..... G07F 17/32 273/138.2
6,712,693 B1 * 3/2004 Hettinger ..... G07F 17/32 463/20
6,761,632 B2 * 7/2004 Bansemer ..... A63F 9/0291 463/16
6,761,633 B2 * 7/2004 Riendeau ..... A63F 3/081 463/16
6,764,397 B1 * 7/2004 Robb ..... A63F 9/24 340/323 R
6,811,482 B2 * 11/2004 Letovsky ..... G07F 17/32 463/20
7,118,105 B2 * 10/2006 Benevento ..... A63B 67/02 273/121 B
7,294,058 B1 * 11/2007 Slomiany ..... G07F 17/32 463/31
7,361,091 B2 * 4/2008 Letovsky ..... A63F 13/10 463/23
7,517,282 B1 * 4/2009 Pryor ..... A63F 13/12 463/1
7,575,517 B2 * 8/2009 Parham ..... G07C 15/006 273/138.2
7,720,733 B2 * 5/2010 Jung ..... G06Q 20/10 705/35
7,753,790 B2 * 7/2010 Nguyen ..... G07F 17/3276 273/143 R
7,766,742 B2 * 8/2010 Bennett ..... G07F 17/34 273/138.1
7,775,885 B2 * 8/2010 Van Luchene ..... A63F 13/10 463/42
7,798,896 B2 * 9/2010 Katz ..... A63F 3/00157 463/20
7,828,657 B2 * 11/2010 Booth ..... A63F 13/12 463/1
7,917,371 B2 * 3/2011 Jung ..... G06Q 30/018 705/1.1
7,938,727 B1 * 5/2011 Konkle ..... A63F 13/27 273/454
7,980,948 B2 * 7/2011 Rowe ..... G07F 17/3288 463/20
7,996,264 B2 * 8/2011 Kusumoto ..... G06Q 30/02 705/14.16
8,012,023 B2 * 9/2011 Gates, III ..... G06F 3/011 463/31
8,047,915 B2 * 11/2011 Lyle ..... A63F 13/12 463/31
8,060,829 B2 * 11/2011 Jung ..... G06N 3/006 705/39
8,087,999 B2 * 1/2012 Oberberger ..... G07F 17/32 463/25
8,118,654 B1 * 2/2012 Nicolas ..... G06Q 40/00 463/1
8,128,487 B2 * 3/2012 Hamilton, II ..... A63F 13/12 273/138.1
8,135,648 B2 * 3/2012 Oram ..... G06Q 20/3674 463/17
8,137,193 B1 * 3/2012 Kelly ..... A63F 13/537 463/1
8,157,653 B2 * 4/2012 Buhr ..... A63F 13/795 463/42
8,167,699 B2 * 5/2012 Inamura ..... G07F 17/32 463/16
8,177,628 B2 * 5/2012 Manning ..... G06Q 20/3224 463/21
8,182,338 B2 * 5/2012 Thomas ..... G07F 17/32 463/25
8,182,339 B2 * 5/2012 Anderson ..... G06Q 10/087 463/30
8,206,210 B2 * 6/2012 Walker ..... G07F 17/32 463/20
8,480,470 B2 * 7/2013 Napolitano ..... G07F 17/32 463/16
8,622,809 B1 * 1/2014 Arora ..... G07F 17/3258 463/20
8,998,694 B2 * 4/2015 Rowe ..... G07F 17/32 463/13
9,070,257 B1 * 6/2015 Scalise ..... G07F 17/326
2001/0004609 A1 * 6/2001 Walker ..... A63F 13/12 463/42
2001/0019965 A1 * 9/2001 Ochi ..... G06Q 50/34 463/25
2002/0022509 A1 * 2/2002 Nicastro, II ..... G07F 17/32 463/15
2002/0090990 A1 * 7/2002 Joshi ..... G07F 17/32 463/20
2002/0175471 A1 * 11/2002 Faith ..... G07F 17/3244 273/440
2003/0060286 A1 * 3/2003 Walker ..... G07F 17/32 463/42
2003/0119576 A1 * 6/2003 McClintic ..... G07F 17/32 463/20
2003/0139214 A1 * 7/2003 Wolf ..... G07F 17/32 463/42
2003/0171149 A1 * 9/2003 Rothschild ..... G07F 17/32 463/42
2003/0204565 A1 * 10/2003 Guo ..... A63F 13/12 709/205
2003/0211879 A1 * 11/2003 Englman ..... G07F 17/3244 463/20
2004/0092313 A1 * 5/2004 Saito ..... A63F 13/12 463/42
2004/0102238 A1 * 5/2004 Taylor ..... G07F 17/32 463/16
2004/0121839 A1 * 6/2004 Webb ..... G07F 17/32 463/29
2004/0225387 A1 * 11/2004 Smith, III ..... G07F 17/32 700/92
2005/0003878 A1 * 1/2005 Updike ..... G06Q 50/34 463/16
2005/0096124 A1 * 5/2005 Stronach ..... G06Q 30/06 463/25
2005/0116411 A1 * 6/2005 Herrmann ..... G06Q 20/22 273/146
2005/0192087 A1 * 9/2005 Friedman ..... G07F 17/32 463/25
2005/0233791 A1 * 10/2005 Kane ..... A63F 13/12 463/6
2005/0233806 A1 * 10/2005 Kane ..... G07F 17/32 463/31
2005/0239538 A1 * 10/2005 Dixon ..... G07F 17/3267 463/20
2005/0269778 A1 * 12/2005 Samberg ..... A63F 11/0051 273/292
2005/0288101 A1 * 12/2005 Lockton ..... A63F 13/332 463/40
2006/0003823 A1 * 1/2006 Zhang ..... A63F 13/12 463/1
2006/0003830 A1 * 1/2006 Walker ..... G06Q 10/063 463/20
2006/0035696 A1 * 2/2006 Walker ..... G07F 17/32 463/16
2006/0040735 A1 * 2/2006 Baerlocher ..... G07F 17/32 463/26
2006/0084499 A1 * 4/2006 Moshal ..... 463/25
2006/0084505 A1 * 4/2006 Yoseloff ..... G07F 17/32 463/42
2006/0135250 A1 * 6/2006 Rossides ..... A63F 9/24 463/25
2006/0154710 A1 * 7/2006 Serafat ..... A63F 13/10 463/1
2006/0166729 A1 * 7/2006 Saffari ..... G07F 17/32 463/17
2006/0189371 A1 * 8/2006 Walker ..... G07F 17/3227 463/16

(56) References Cited

U.S. PATENT DOCUMENTS

2006/0223611 A1* 10/2006 Baerlocher ..... G07F 17/3244 463/16
2006/0234791 A1* 10/2006 Nguyen ..... G07F 17/32 463/16
2006/0240890 A1* 10/2006 Walker ..... G07F 17/32 463/23
2006/0246403 A1* 11/2006 Monpouet ..... A63F 3/00643 434/128
2006/0258433 A1* 11/2006 Finocchio ..... A63F 3/062 463/16
2007/0026924 A1* 2/2007 Taylor ..... G07F 17/32 463/16
2007/0035548 A1* 2/2007 Jung ..... G06Q 30/0601 345/474
2007/0038559 A1* 2/2007 Jung ..... G06Q 20/10 705/39
2007/0064074 A1* 3/2007 Silverbrook ..... B41J 3/36 347/101
2007/0087799 A1* 4/2007 Van Luchene ..... A63F 13/847 463/1
2007/0093299 A1* 4/2007 Bergeron ..... G07F 17/32 463/43
2007/0099696 A1* 5/2007 Nguyen ..... G06Q 10/10 463/25
2007/0117641 A1* 5/2007 Walker ..... A63F 13/12 473/131
2007/0129149 A1* 6/2007 Walker ..... G07F 17/32 463/42
2007/0142108 A1* 6/2007 Linard ..... A63F 9/18 463/22
2007/0156509 A1* 7/2007 Jung ..... G06Q 30/0209 705/14.12
2007/0167212 A1* 7/2007 Nguyen ..... G07F 17/32 463/16
2007/0167239 A1* 7/2007 O'Rourke ..... G07F 17/32 463/42
2007/0173311 A1* 7/2007 Morrow ..... A63F 3/00643 463/16
2007/0191104 A1* 8/2007 Van Luchene ..... G07F 17/32 463/42
2007/0202941 A1* 8/2007 Miltenberger ..... G07F 17/32 463/25
2007/0203828 A1* 8/2007 Jung ..... G06Q 40/025 705/38
2007/0207847 A1* 9/2007 Thomas ..... G07F 17/32 463/17
2007/0259717 A1* 11/2007 Mattice ..... A63F 3/00157 463/36
2007/0293306 A1* 12/2007 Nee ..... G07F 17/32 463/25
2008/0004107 A1* 1/2008 Nguyen ..... G06Q 10/10 463/29
2008/0014835 A1* 1/2008 Weston ..... A63H 30/04 446/484
2008/0015004 A1* 1/2008 Gatto ..... G07F 17/32 463/16
2008/0064488 A1* 3/2008 Oh ..... G06F 17/32 463/25
2008/0070659 A1* 3/2008 Naicker ..... G06F 17/32 463/12
2008/0070690 A1* 3/2008 Van Luchene ..... A63F 13/12 463/42
2008/0070702 A1* 3/2008 Kaminkow ..... G07F 17/32 463/46
2008/0096665 A1* 4/2008 Cohen ..... A63F 13/12 463/42
2008/0108406 A1* 5/2008 Oberberger ..... G07F 17/32 463/16
2008/0108425 A1* 5/2008 Oberberger ..... G07F 17/32 463/25
2008/0113704 A1* 5/2008 Jackson ..... G07F 17/32 463/13
2008/0146308 A1* 6/2008 Okada ..... G07F 17/32 463/17
2008/0161081 A1* 7/2008 Berman ..... G07F 17/32 463/9
2008/0176619 A1* 7/2008 Kelly ..... A63F 3/081 463/16
2008/0191418 A1* 8/2008 Lutnick ..... A63F 1/00 273/303
2008/0195481 A1* 8/2008 Lutnick ..... G06Q 30/0239 705/14.39
2008/0248850 A1* 10/2008 Schugar ..... G07F 17/32 463/16
2008/0254893 A1* 10/2008 Patel ..... G07F 17/3267 463/42
2008/0274796 A1* 11/2008 Lube ..... G07F 17/32 463/25
2008/0274798 A1* 11/2008 Walker ..... G07F 17/32 463/25
2008/0311980 A1* 12/2008 Cannon ..... G07F 17/32 463/25
2008/0318668 A1* 12/2008 Ching ..... G07F 17/3258 463/25
2009/0011827 A1* 1/2009 Englman ..... G07F 17/34 463/27
2009/0023489 A1* 1/2009 Toneguzzo ..... G07F 17/32 463/16
2009/0023492 A1* 1/2009 Erfanian ..... G07F 17/32 463/23
2009/0061974 A1* 3/2009 Lutnick ..... G07F 17/32 463/13
2009/0061975 A1* 3/2009 Ditchev ..... G07F 17/32 463/13
2009/0061999 A1* 3/2009 Popovich ..... G07F 17/32 463/26
2009/0082093 A1* 3/2009 Okada ..... G07F 17/32 463/25
2009/0088239 A1* 4/2009 Iddings ..... G07F 17/3239 463/20
2009/0098934 A1* 4/2009 Amour ..... G06Q 20/20 463/25
2009/0118006 A1* 5/2009 Kelly ..... G07F 17/32 463/31
2009/0124344 A1* 5/2009 Mitchell ..... G07F 17/32 463/20
2009/0131158 A1* 5/2009 Brunet De Courssou ..... G07F 17/32 463/26
2009/0131175 A1* 5/2009 Kelly ..... G07F 17/3267 463/42
2009/0143141 A1* 6/2009 Wells ..... G07F 17/32 463/37
2009/0149233 A1* 6/2009 Strause ..... G06Q 50/34 463/7
2009/0156297 A1* 6/2009 Andersson ..... G07F 17/3234 463/25
2009/0176560 A1* 7/2009 Herrmann ..... G06Q 30/02 463/25
2009/0176566 A1* 7/2009 Kelly ..... G07F 17/32 463/29
2009/0181777 A1* 7/2009 Christiani ..... G07F 17/32 463/42
2009/0221355 A1* 9/2009 Dunaevsky ..... G07F 17/32 463/20
2009/0239610 A1* 9/2009 Olive ..... G07F 17/3244 463/20
2009/0247272 A1* 10/2009 Abe ..... 463/20
2009/0270164 A1* 10/2009 Seelig ..... G07F 17/32 463/20
2009/0291755 A1* 11/2009 Walker ..... G06Q 30/02 463/29
2009/0309305 A1* 12/2009 May ..... A63F 3/00157 273/292
2009/0312093 A1* 12/2009 Walker ..... G07F 17/32 463/25
2009/0325686 A1* 12/2009 Davis ..... G07F 17/32 463/25

(56) References Cited

U.S. PATENT DOCUMENTS

2010/0004058 A1* 1/2010 Acres ..... G07F 17/32 463/27
2010/0016056 A1* 1/2010 Thomas ..... G07F 17/32 463/20
2010/0029373 A1* 2/2010 Graham ..... G07F 17/32 463/25
2010/0035674 A1* 2/2010 Slomiany ..... G07F 17/32 463/9
2010/0056247 A1* 3/2010 Nicely ..... G07F 17/3211 463/20
2010/0056260 A1* 3/2010 Fujimoto ..... G06Q 20/381 463/25
2010/0062836 A1* 3/2010 Young ..... G07F 17/32 463/25
2010/0093420 A1* 4/2010 Wright ..... G07F 17/32 463/17
2010/0093444 A1* 4/2010 Biggar ..... G07F 17/3295 463/43
2010/0105454 A1* 4/2010 Weber ..... G06Q 30/02 463/1
2010/0120525 A1* 5/2010 Baerlocher ..... G07F 17/32 463/29
2010/0124983 A1* 5/2010 Gowin ..... G07F 17/32 463/25
2010/0137047 A1* 6/2010 Englman ..... G07F 17/32 463/6
2010/0174593 A1* 7/2010 Cao ..... A63F 13/12 705/14.12
2010/0184509 A1* 7/2010 Sylla ..... H04L 9/3268 463/29
2010/0203940 A1* 8/2010 Alderucci ..... G07F 17/32 463/16
2010/0210344 A1* 8/2010 Edidin ..... G07F 17/32 463/20
2010/0227672 A1* 9/2010 Amour ..... G06Q 20/10 463/25
2010/0227688 A1* 9/2010 Lee ..... A63F 13/12 463/31
2010/0240436 A1* 9/2010 Wilson ..... G07F 17/3244 463/20
2010/0285869 A1* 11/2010 Walker ..... G07F 17/32 463/25
2010/0304825 A1* 12/2010 Davis ..... G07F 17/32 463/17
2010/0304839 A1* 12/2010 Johnson ..... A63F 13/80 463/23
2011/0009178 A1* 1/2011 Gerson ..... G07F 17/3295 463/17
2011/0045896 A1* 2/2011 Sak ..... G07F 17/3244 463/25
2011/0070945 A1* 3/2011 Walker ..... G07F 17/3258 463/25
2011/0077087 A1* 3/2011 Walker ..... G07F 17/32 463/42
2011/0082571 A1* 4/2011 Murdock ..... A63B 24/0021 700/92
2011/0105206 A1* 5/2011 Rowe ..... G07F 17/32 463/9
2011/0107239 A1* 5/2011 Adoni ..... A63F 13/12 715/757
2011/0109454 A1* 5/2011 McSheffrey, Sr. ..... A61N 1/39 340/568.1
2011/0111820 A1* 5/2011 Filipour ..... G07F 17/32 463/16
2011/0111837 A1* 5/2011 Gagner ..... G07F 17/3211 463/25
2011/0111841 A1* 5/2011 Tessmer ..... G07F 17/32 463/25
2011/0118011 A1* 5/2011 Filipour ..... G07F 17/32 463/27
2011/0207523 A1* 8/2011 Filipour ..... G07F 17/32 463/25
2011/0212766 A1* 9/2011 Bowers ..... G07F 17/32 463/25
2011/0212767 A1* 9/2011 Barclay ..... G07F 17/32 463/25
2011/0218028 A1* 9/2011 Acres ..... A63F 9/24 463/20
2011/0218035 A1* 9/2011 Thomas ..... G07F 17/32 463/25
2011/0230258 A1* 9/2011 Van Luchene ..... A63F 13/35 463/29
2011/0230260 A1* 9/2011 Morrow ..... G07F 17/32 463/30
2011/0230267 A1* 9/2011 Van Luchene ..... A63F 13/77 463/42
2011/0244944 A1* 10/2011 Baerlocher ..... G07F 17/3244 463/20
2011/0263312 A1* 10/2011 De Waal ..... A63F 7/02 463/20
2011/0269522 A1* 11/2011 Nicely ..... G07F 17/32 463/18
2011/0275440 A1* 11/2011 Faktor ..... G07F 17/32 463/42
2011/0287828 A1* 11/2011 Anderson ..... G07F 17/32 463/25
2011/0287841 A1* 11/2011 Watanabe ..... G07F 17/329 463/42
2011/0312408 A1* 12/2011 Okuaki ..... G07F 17/32 463/25
2011/0319153 A1* 12/2011 Gomez ..... G07F 17/326 463/20
2011/0319169 A1* 12/2011 Lam ..... A63F 13/792 463/42
2012/0004747 A1* 1/2012 Kelly ..... G07F 17/3239 700/91
2012/0028701 A1* 2/2012 Gomez ..... G07F 17/3211 463/25
2012/0028718 A1* 2/2012 Barclay ..... G07F 17/3218 463/42
2012/0058814 A1* 3/2012 Lutnick ..... G07F 17/3258 463/25
2012/0077569 A1* 3/2012 Watkins ..... G07F 17/3267 463/25
2012/0135793 A1* 5/2012 Antonopoulos ..... A63F 3/0605 463/17
2012/0202587 A1* 8/2012 Allen ..... G07F 17/3223 463/25
2012/0302311 A1* 11/2012 Luciano, Jr. ..... G07F 17/32 463/17
2012/0322545 A1* 12/2012 Arnone ..... G07F 17/3272 463/25
2013/0029760 A1* 1/2013 Wickett ..... G06F 16/27 463/29
2013/0122995 A1* 5/2013 Detlefsen ..... G07F 17/3225 463/25
2013/0131848 A1* 5/2013 Arnone ..... G07F 17/3244 700/91
2013/0260869 A1* 10/2013 Basallo ..... G07F 17/3267 463/25
2014/0087801 A1* 3/2014 Nicely ..... G07F 17/3293 463/12
2014/0087808 A1* 3/2014 Basallo ..... G07F 17/3262 463/16
2014/0087809 A1* 3/2014 Leupp ..... G07F 17/326 463/16
2014/0357350 A1* 12/2014 Weingardt ..... G07F 17/3258 463/27
2017/0148271 A1* 5/2017 Graboyes Goldman ..... G07F 17/3295

* cited by examiner

HYBRID GAMING SYSTEM HAVING OMNISCIENCE GAMBLING PROPOSITION

CROSS-REFERENCE TO RELATED APPLICATIONS

The current application is a continuation of U.S. application Ser. No. 15/882,333, filed Jan. 29, 2018, which is a continuation of U.S. patent application Ser. No. 14/586,639, filed Dec. 30, 2014, which is a continuation of PCT Application No. PCT/US2013/48986, filed Jul. 1, 2013, which claims priority to U.S. Provisional Application No. 61/666,865, filed Jun. 30, 2012, the disclosure of each of which is incorporated by reference as if set forth herewith. The current application is also related to PCT Applications PCT/US11/26768 filed Mar. 1, 2011, and PCT/US11/63587 filed Dec. 6, 2011, both of which are incorporated by reference as if set forth herewith. The current application is further related to US Provisional Patent Applications: 61/459,131 filed Dec. 6, 2010; 61/460,362 filed Dec. 31 2012; and 61/574,753 filed Aug. 9, 2011, all of which are incorporated by reference as if set forth herewith.

FIELD OF THE INVENTION

Embodiments of the present invention are generally related to data processing for wagering games and more specifically to systems and processes that provide a omniscience gambling proposition that allows the player to receive target information that relates to the state of an entertainment game.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based.

SUMMARY OF THE INVENTION

Systems and methods in accordance with embodiments of the invention provide a gambling hybrid game an omniscience mode on a computing device. In accordance with embodiments of the invention, an electromechanical gaming machine provides for execution of a hybrid game having an entertainment game and a gambling game. The electromechanical gaming machine includes a user input device, a user output device, and an entertainment engine connected to a game world engine, wherein the entertainment engine is configured to execute the entertainment game, provide an invitation to accept an omniscience gambling proposition wherein the omniscience gambling proposition provides information about an entertainment game state, and receive input from a user to accept the omniscience gambling proposition via the user input device. The electromechanical gaming machine further includes a real world engine connected to the game world engine, wherein the real world engine is configured to receive from the game world engine, a request to determine a result of a gambling event associated with the omniscience gambling proposition, determine the result of the gambling event using a random number generator and a pay-table, distribute to the game world engine the results of the gambling event. The game world engine is connected to the entertainment engine and is configured to receive the acceptance of the omniscience gambling proposition from the entertainment engine, request the result of the gambling event from the real world engine, receive the result of the gambling event from the real world engine, determine the result of the omniscience gambling proposition including the information to provide to the entertainment engine based on the results of the omniscience gambling proposition, and distribute the information and timing instructions to the entertainment engine. The entertainment engine is further configured to receive the information from the game world engine, determine the entertainment game state associated with the information, display the entertainment game state to the user through a user interface using the user output device based on the timing instructions.

In another embodiment, the game world engine is further configured to determine changes to a set of entertainment game variables based on the result of the gambling event.

In yet another embodiment, the game world engine is further configured to provide the changes to the set of game variables to the entertainment engine, and the entertainment engine is further configured to receive the changes to the set of game variables from the game world engine and incorporate the changes in the set of game variables into the entertainment game.

In yet another embodiment, the game world engine is further configured to initiate the entertainment engine to provide the invitation to participate in the omniscience gambling event to the user.

In another embodiment, the real world engine is further configured to resolve a wager of real world credits on the gambling event based upon the result of the gambling event, and update an real world credit account associated according to the result of the wager.

In yet another embodiment, the game world engine and the real world engine are configured from the same device.

In yet another embodiment, the game world engine is connected to the entertainment engine by a network.

In yet another embodiment, the entertainment engine and the game world engine are configured from the same device.

In yet another embodiment, the game world engine is connected to the real world engine by a network.

In yet another embodiment, the entertainment engine, the game world engine, and the real world engine are configured from the same device.

DETAILED DISCLOSURE OF THE INVENTION

Turning now to the drawings, gambling hybrid games that provide an omniscience mode in accordance with some embodiments of the invention are illustrated. In an omniscience mode, the player is provided some game related information that is not available to the player in conventional game play in or out of context of the gambling hybrid game. The information may be given in anticipation of wagering on a proposition of a gambling event or may be given as a result of a gambling event. The provided information, "Target Information", essentially provides the player with intelligence about the state of game play that provides a level of omniscience to the player. A non-exhaustive list of exemplary Target Information follows: In Battleship, a player may be exposed to a view of a portion of his opponents board, either permanently, or temporarily; In Scrabble, a player may be exposed to some or all of his opponent(s) tiles, for a fixed period of time; In a gambling hybrid game version of World of Tanks, a multiplayer tank battle game, the player may receive a radio communication from his "General" indicating that "intelligence indicates the enemy's tanks are proceeding due east along the river bank"; In a game of Texas Hold 'Em, a player may be given a view as to the next card in the dealer's deck, the cards in the discard pile, and/or one or more of the cards held by his opponent(s). The player may be exposed to the target information as a result of the outcome of a gambling game, dubbed an Omniscience Gambling Proposition (OGP). The GWE exposes the player to this proposition when conditions in the entertainment game warrant and may also take into account other factors, such as Casino policy, data derived from the player's account, player preferences, the number of omniscience gambling propositions offered and/or accepted by the player during this game session or a given period of time.

Game Gambling Hybrid Games

Figure 1:
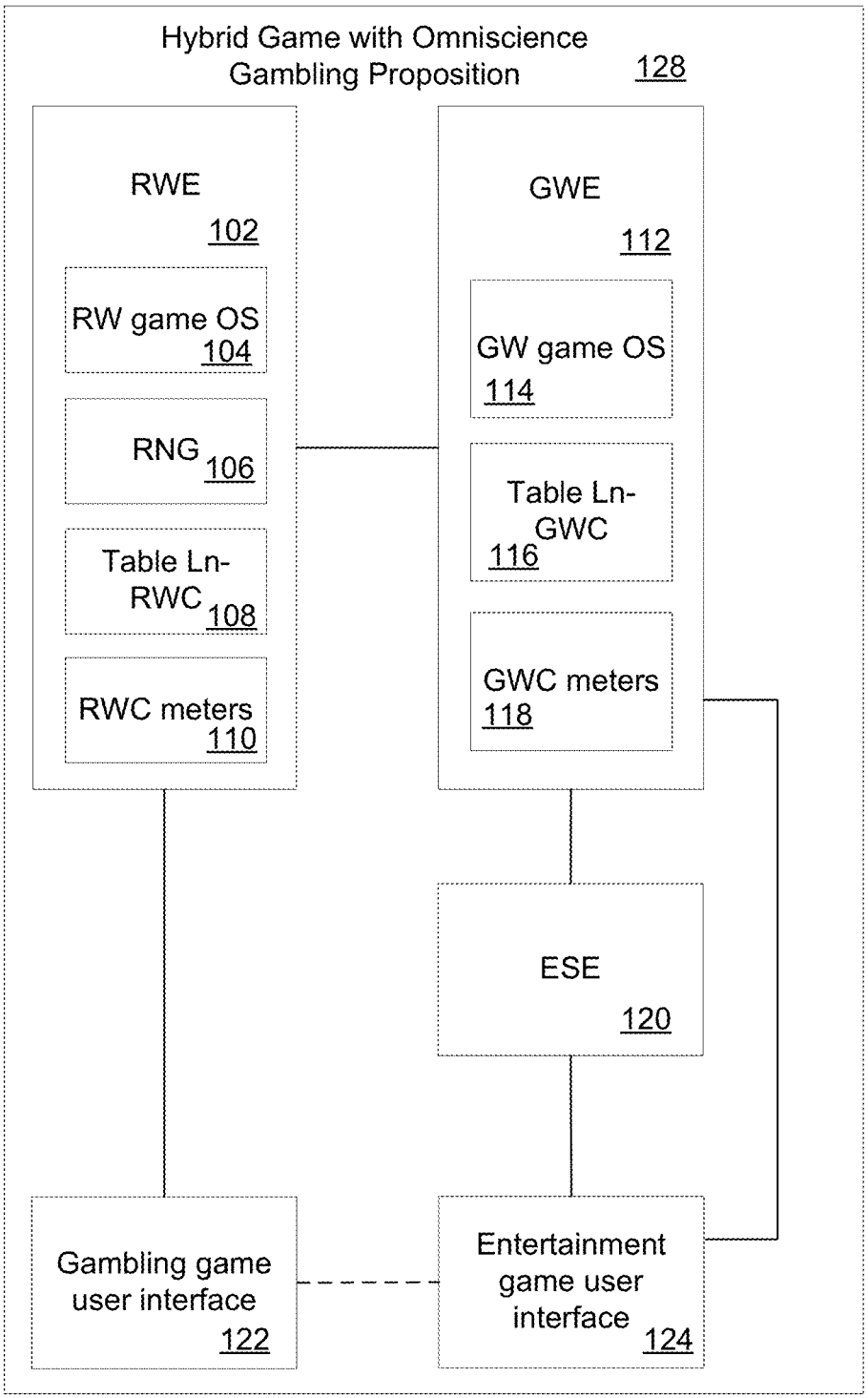
FIG. 1 illustrates a conceptual diagram of components of a gambling hybrid game in accordance with an embodiment of the invention.

In accordance with many embodiments of the invention, a gambling hybrid game integrates high-levels of entertainment content with a game of skill (entertainment game) and a gambling experience with a game of chance (gambling game). A gambling hybrid game provides for random outcomes independent of player skill while providing that the user's gaming experience (as measured by obstacles/challenges encountered, time of play and other factors) is shaped by the player's skill. The outcome of a gambling proposition that is determined by a Random Number Generator (RNG) or other such device that provides a random outcome in response to a request. In accordance with some embodiments, the wager game may be initiated in response to a game object related player action. A gambling hybrid game in accordance with an embodiment of the invention is illustrated in FIG. 1. The gambling hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the gambling hybrid game 128 and controls and operates the gambling game. The operation of a gambling game is enabled by Real World Currency (RWC), such as money or other real world funds. A gambling game can increase or decrease an amount of RWC based on random gambling outcomes, where the gambling proposition of a gambling game is typically regulated by gaming control bodies. In many embodiments, the RWE includes a Real World (RW) operating system (OS) 104, RNG 106, level n real-world credit pay tables (table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (table Ln-RWC) 108 is a table that can be used in conjunction with a random number generator (RNG) 106 to dictate the RWC earned as a function of sponsored gameplay and is analogous to the pay tables used in a conventional slot machine. Table Ln-RWC payouts are independent of player skill. There can be one table or multiple tables included in Ln-RWC pay tables 108 contained in a gambling game, the selection of which can be determined by factors including (but not limited to) game progress that a player has earned, and/or bonus rounds for which a player can be eligible. RWCs are credits analogous to slot machine game credits, which are entered into a gambling game by the user, either in the form of money such as hard currency or electronic funds. RWCs can be decremented or augmented based on the outcome of a random number generator according to the table Ln-RWC real world credits pay table 108, independent of player skill. In certain embodiments, an amount of RWC can be used as criteria in order to enter higher ESE game levels. RWC can be carried forward to higher game levels or paid out if a cash out is opted for by a player. The amount of RWC used to enter a specific level of the game level n need not be the same for each level.

In accordance with some embodiments of the invention, the GWE 112 manages the overall gambling hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an operating system (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a RNG. In accordance with some embodiments, GWCs are player points earned or depleted as a function of player skill, specifically as a function of player performance in the context of the game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In accordance with various embodiments of the invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of a draw certificate based gambling hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special potion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a gambling hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the gambling hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, gambling hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
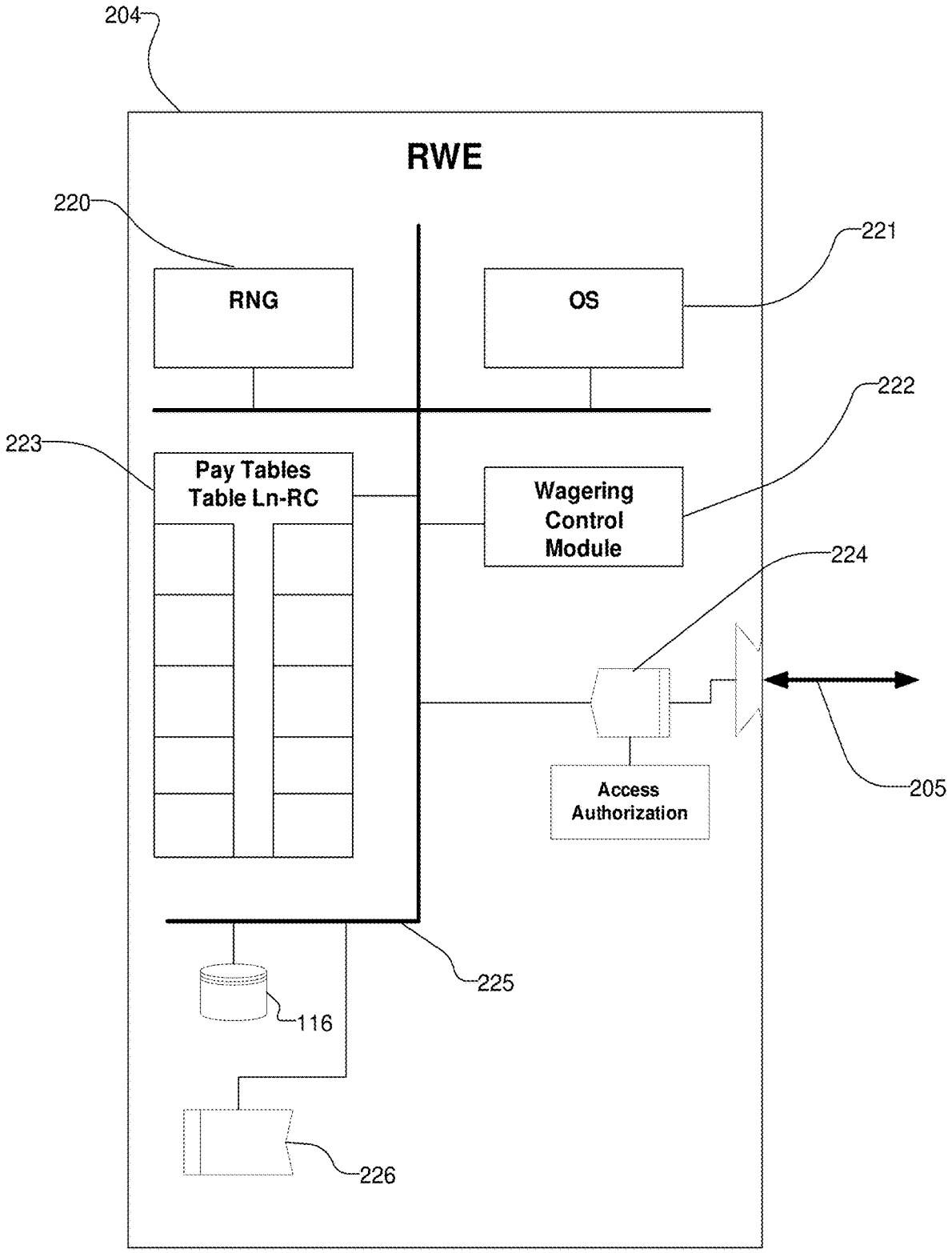
FIG. 2 illustrates a conceptual diagram of aspects of a Real World Engine (RWE) of a gambling hybrid game in accordance with embodiments of the invention.

The components provided by the RWE for a gambling hybrid game in accordance with embodiments of the invention are shown in FIG. 2. In accordance with embodiments of the invention, the RWE includes an internal bus 225 that connects an operating system OS 221, a Random Number Generator ("RNG") 220, one or more pay tables (Table Ln-RC) 223 which would control the functions of the RWE, a Random Number Generator ("RNG") 220 to produce random numbers, one or more pay tables (Table Ln-RC) 223, a wagering control module 222, an authorization access module 224, and a RC credit meter 226 that are included in the RWE 204. The RW OS 221 controls the functions of the RWE. The RNG 220 includes one or more RNGs that are used to produce random numbers for use in resolving gambling events and other process requiring a random number to determine an outcome. The one or more pay tables (Table Ln-RC) 223 contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. a repository (a credit meter) 926 maintains a record of the amount of RC which player has deposited in the game and has been accumulated by the player.

An external connection allows the RWE 204 to interface to another system or device, which is shown in FIG. 2 as the internet 205 but may be any other network and/or device. The authorization access module 224 of RWE 204 is connected to the external connection and provides a method to permit access and command exchange between an external system and the RWE 904. The RWE 904 also contains storage for statuses, wagers, wager outcomes, meters and other historical events in a storage device 116.

Figure 3:
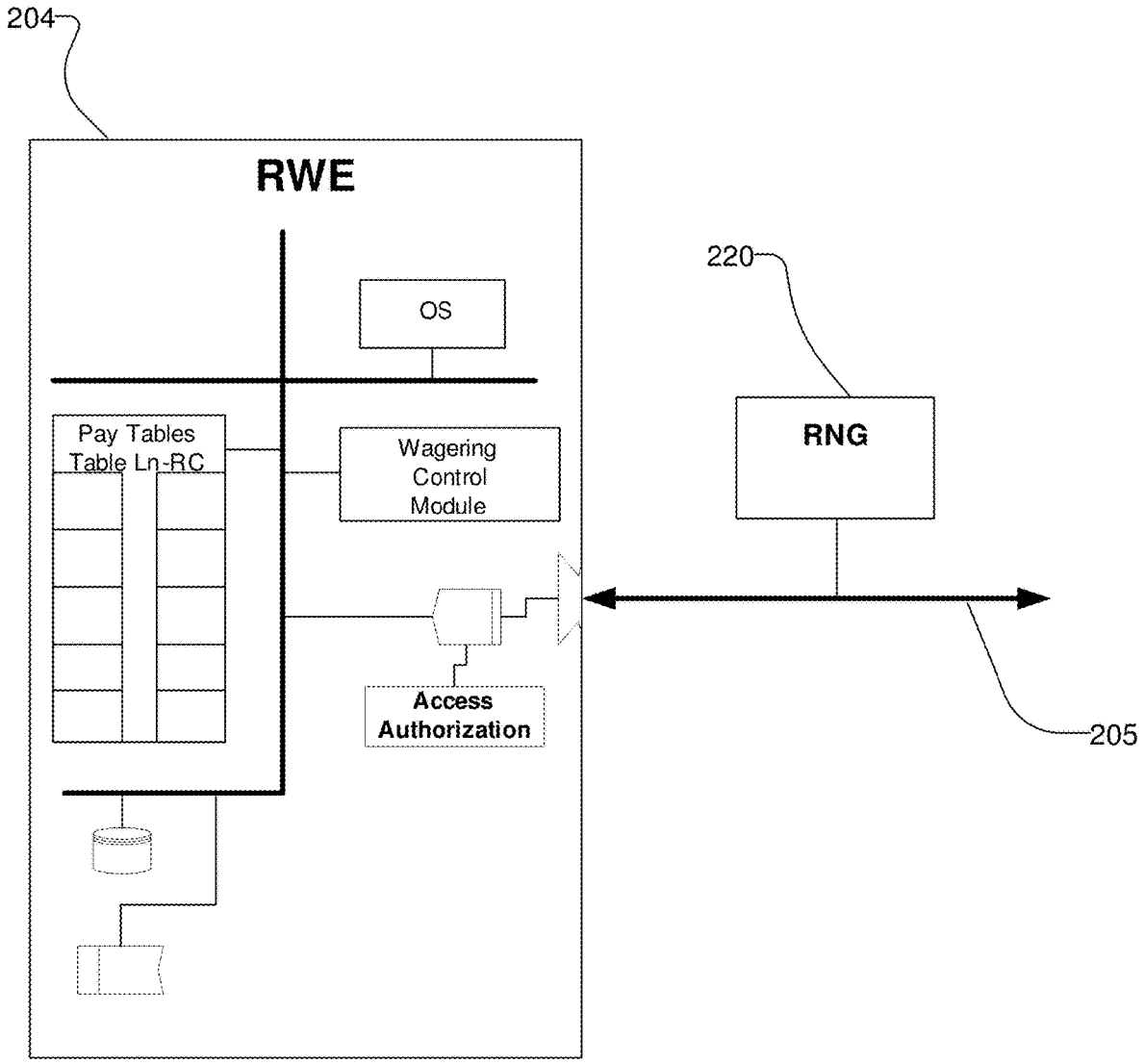
FIG. 3 illustrates a conceptual diagram of other aspects of a Real World Engine of a gambling hybrid game in accordance with embodiments of the invention.

In some embodiments, the RWE communicates with external systems to provide various functions of a gambling hybrid game in accordance with embodiments of the invention. The components of an RWE that communicates with an external system to provide a component of the RWE in accordance with embodiments of the invention are shown in FIG. 3. The RWE 204 shown in FIG. 3 is similar to the RWE shown in FIG. 2. However, the RNG 220 which is an external system connected to the RWE 204 by the internet 905 in accordance with embodiments of the invention. The RNG 220 could be a central deterministic system, such as a regulated and controlled random numbered ball selection device, or some other system which provides random or pseudo random numbers to one or a plurality of connected RWEs 204. One skilled in the art will recognize that only RNG 220 is an external system in the shown embodiments. However, any of the components could be external systems without departing from the invention and RNG 220 is shown as an example only.

In FIGS. 2 and 3, the RWE 204 interfaces with other systems/devices or to an external RNG 220 using the Internet 205. However, one skilled in the art will note that nothing would preclude using a different interface than the internet 205 in other embodiments of the invention. Other examples of interfaces include, but are not limited to, a LAN, a USB interface, or some other method by which two electronic and software constructs could communicate with each other.

Figure 4:
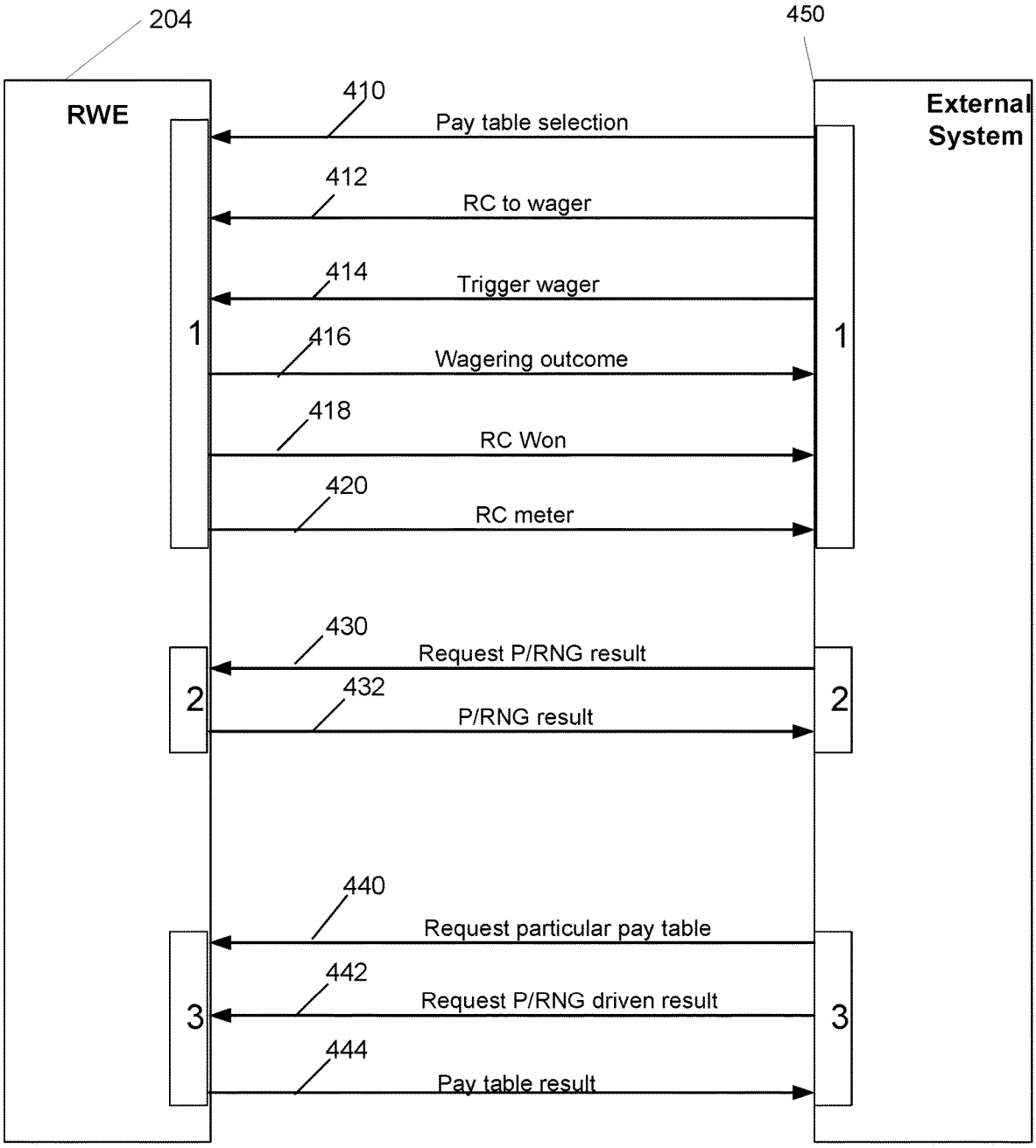
FIG. 4 illustrates a signaling diagram of communications between a Real World Engine (RWE) and an external system to provide various functions in accordance with embodiments of the invention.

The RWE and an external system typically communicate to provide the resolution of gambling events to resolve wagers on the events. The signals between the RWE and an external system to provide some process related to resolving gambling events in accordance with embodiments of the invention are shown in FIG. 4. In accordance with embodiments of the invention, the primary function of the RWE 204 is to manage wagering events and to provide random (or pseudo random) numbers from an RNG. At the top of the figure, a 6 component communication exchange grouped by the "1" box is shown for a wager on a proposition in a gambling event during a gambling hybrid game in accordance with embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of the invention that is shown in FIG. 4 is grouped by the "2" box in FIG. 4 and relates to the external system 450 needing an RNG result support from the RWE 204. In this exchange, the external system 450 requests an RNG result from the RWE 204 (430). The RWE 204 returns an RNG result to the external 450 in response to the request (432). The result may be generated as a function of the internal RNG in the RWE 204, or from an RNG external to the RWE 204 to which the RWE 204 is connected.

A third communication exchange between the RWE 204 and the external system 405 in accordance with embodiments of the invention that is shown in FIG. 4 is grouped by the "3" box in the figure and relates to the external system 450 wanting support on coupling an RNG result to a particular Pay Table contained in the RWE 204. In this exchange, the external system 450 instructs the RWE as to the pay table (Table Ln-RC) to use 450. The external system then requests a result whereby the RNG result is coupled to the requested Pay Table (442). The result is returned to the external system 405 by RWE 204 (444). Such an aspect is different from the first exchange shown by the box "1" sequence in that no actual RC wager is conducted. However, such a process t might be useful in coupling certain non-RC wagering entertainment game behaviors and propositions to the same final resultant wagering return which is understood for the gambling hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from the invention.

Figure 5:
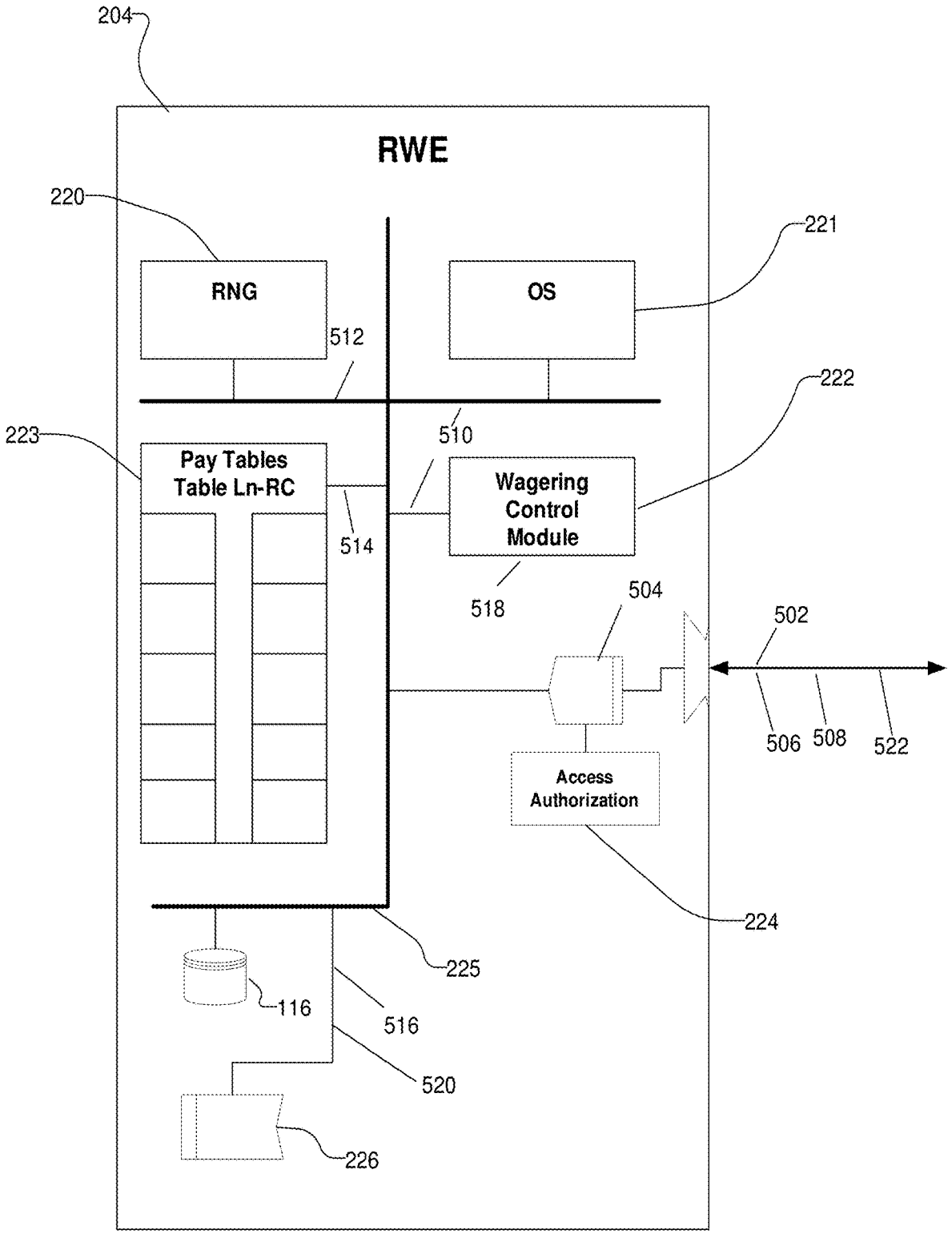
FIG. 5 illustrates a conceptual diagram of a process flow and signaling in an RWE to provide various functions in accordance with embodiments of the invention.

The process flow for functional communication exchanges, such as communication exchanges described above with reference to FIG. 4, between a RWE and an external system in accordance with embodiments of the invention are shown in FIG. 5. The process begins by a RWE 204 receiving signals from an external system requesting a connection to RWE 204. The Access Authorization Module determines that the external system authorized to connect to RWE 204 (504) and transmits an authorization response to the external system. The external systems that provide requests a request for a gambling event is to be performed to RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execute (510). In response to the request to execute the gambling event, the wager control module 222 requests an RNG result from the RNG 220 (512);

retrieves a proper pay table or tables from the pay tables 223 (514); adjusts the RC of the player in the RC repository 926 as instructed (516; applies the RNG result to the particular pay table or tables (518); and multiplies the resultant factor from the Pay Table by the amount of RC to determine the result of the wager (518). Wager Control Module 222 then adds the amount of RC won by the wager to the RC repository 426 (520); and provides he outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
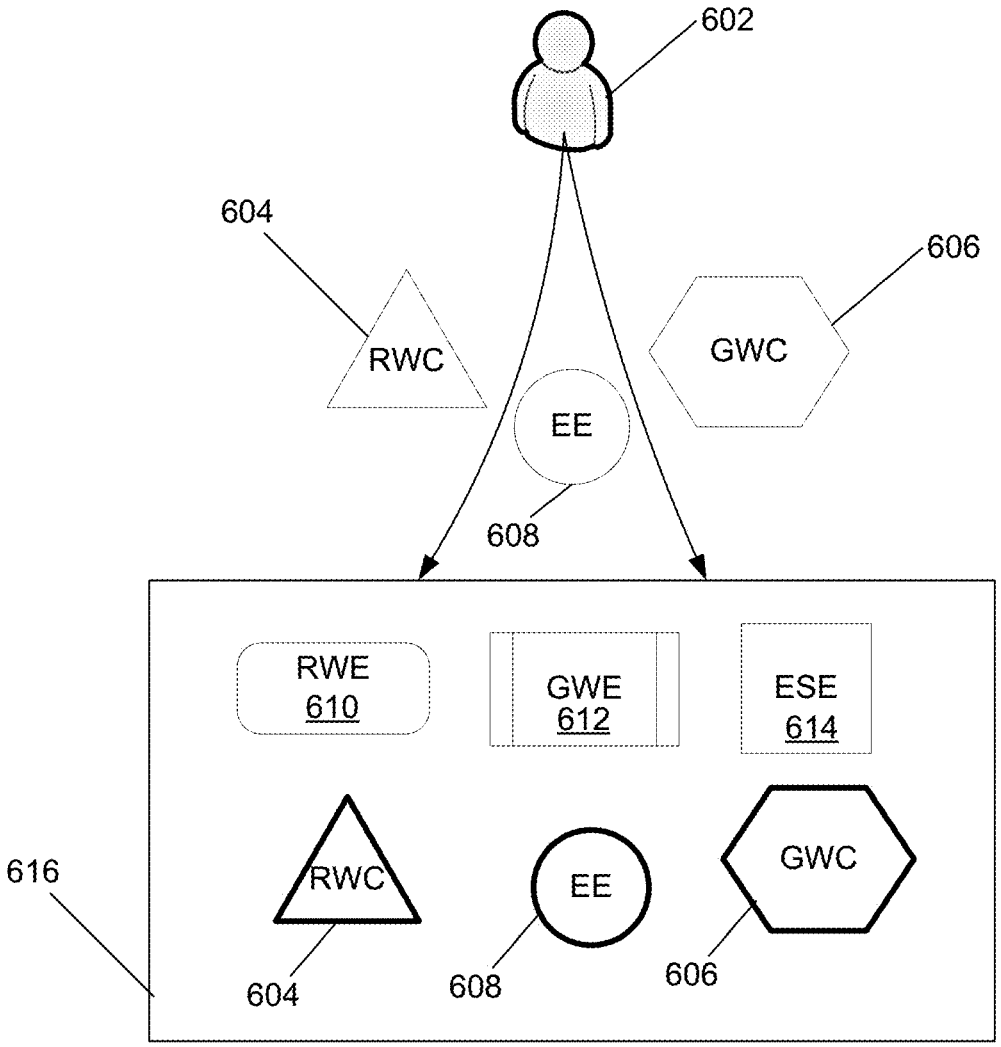
FIG. 6 is a system diagram that illustrates an implementation of a network distributed gambling hybrid game including a game world engine local server in accordance with an embodiment of the invention.

In accordance with some embodiments, a player can interact with a gambling hybrid game by using RWC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RWC and elements, such as but not limited to Entertainment Elements (EE), are utilized in a gambling hybrid game in accordance with an embodiment of the invention is illustrated in FIG. 6. The conceptual diagram illustrates that RWC 604, EE 608 and GWC 606 can be utilized by a player 602 in interactions with the RWE 610, GWE 612 and ESE 614 of a draw certificate based gambling hybrid game 616. The contribution of elements, such as EE 608, can be linked to a player's access to credits, such as RWC 604 or GWC 606. Electronic receipt of these credits can come via a smart card, voucher or other portable media, or as received over a network from a server. In accordance with certain embodiments, these credits can be drawn on demand from a player profile located in a database locally on a gambling hybrid game or in a remote server.

Figure 7:
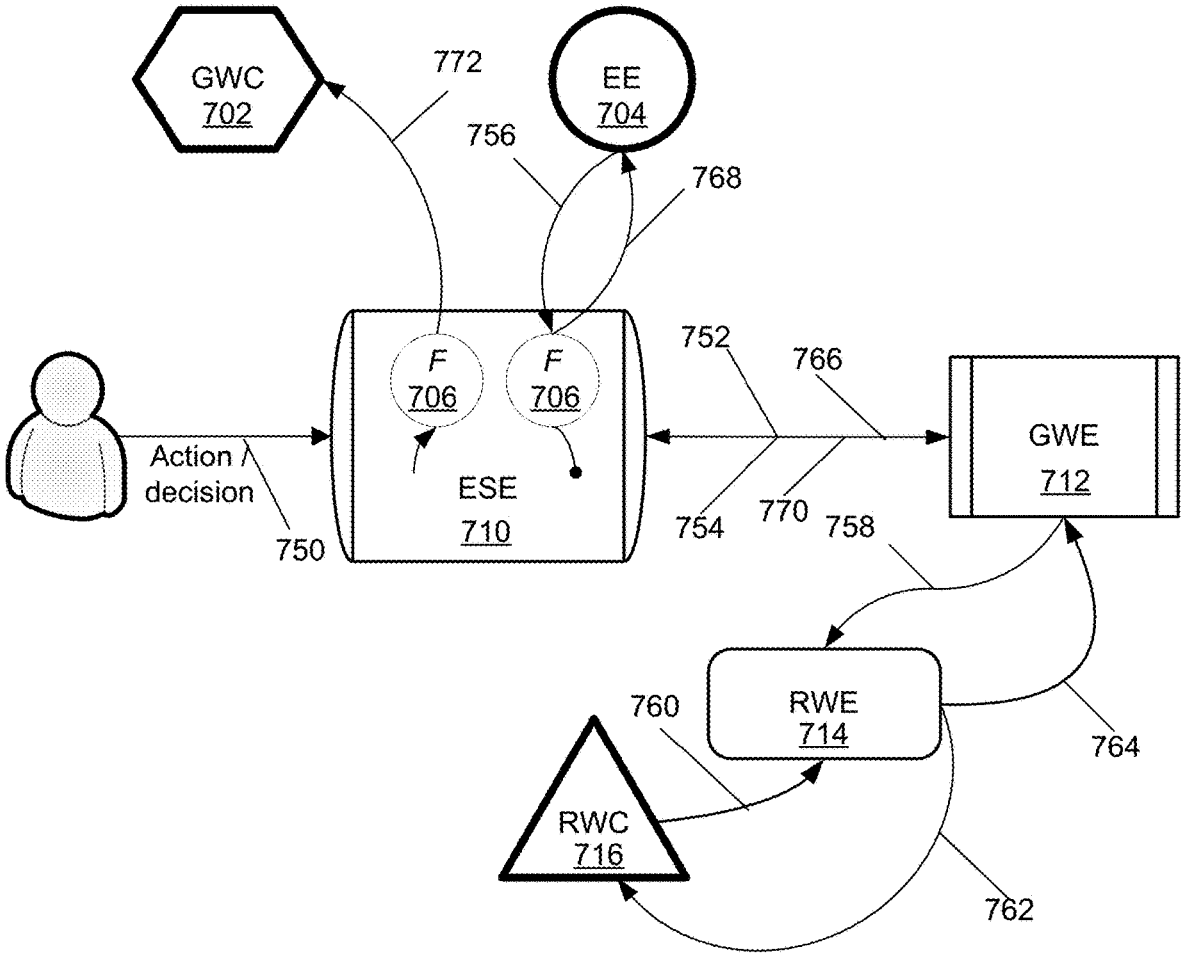
FIG. 7 illustrates a representative state diagram that illustrates an implementation of a network distributed gambling hybrid game in accordance with an embodiment of the invention.

A conceptual diagram that illustrates interplay between elements and components of a gambling hybrid game in accordance with an embodiment of the invention is illustrated in FIG. 7. Similar to FIG. 7, a player's actions and/or decisions can affect functions 306 that consume and/or accumulate GWC 702 and/or EE 704 in an entertainment game executed by an ESE 710. A GWE 712 can monitor the activities taking place within an entertainment game executed by an ESE 710 for gameplay gambling event occurrences. The GWE 712 can also communicate the gameplay gambling event occurrences to an RWE 714 that triggers a wager of RWC 716 in a gambling game executed by the RWE 714.

In accordance with some embodiments of the invention, the following may occur during use of the gambling hybrid game. The user enters an input that represents an action or decision (750). The ESE 710 signals the GWE 712 with the input decision or action (752). The GWE 712 responds by signaling to ESE 710 with the amount of EE that is consumed by the player action or decision (754). The signaling from the GWE 712 configures a function 706 to control the EE consumption, decay, and/or accumulation.

The ESE 710 then adjusts the EE 704 accordingly (756). The GWE 712 signals the RWE 714 as to the profile of the wager proposition associated with the action or decision and triggers the wager (758). The RWE 714 consumes the appropriate amount of RC 716 and executes the wager (760). The RWE 714 then adjusts the RC 716 based upon the outcome of the wager (762) and informs the GWE 712 as to the outcome of the wager (764).

The GWE 712 signals the ESE 710 to adjust EE to one or more of the EEs of the ESE entertainment game (766). Function 706 of the ESE 710 performs the adjustment of EE 304 (768). The ESE 710 signals the GWE 712 as to the updated status (770). In response, the GWE 712 signals the ESE 710 to update GWC of the entertainment game. The ESE updates the GWC using a function 706 (772).

The following is an example of the above flow in a first person shooter game, such a Call of Duty®, using a gambling hybrid game sequence in accordance with embodiments of the invention.

The process begins by a player selecting a machine gun to use in the game and then fires a burst of bullets at an opponent (750). The ESE 710 signals the GWE 712 of the player's choice of weapon, that a burst of bullets was fired, and the outcome of the burst (752). GWE 712 processes the information received and signals ESE 710 to consume 3 bullets (EE) with each pull of the trigger (754). The ESE 710 consumes 3 bullets for the burst using function 706 (756).

The GWE 712 signals the RWE 714 that 3 credits (RC) are to be wagered to match the three bullets consumed. The RWE 714 then obtains a draw certificate from a draw server or the like as discussed further below and determines the result of the wager and may determine the winnings from a pay table. On a particular pay table (Table Ln-RC), a determination is made by RWE 714 as to the amount of damage that the opponent has sustained. The RWE 714 consumes 3 credits of RC 716 for the wager and executes the specified wager (760). The RWE 714 determines that the player hit a jackpot of 6 credits and returns the 6 credits to the RC 716 (762) and signals the GWE 712 that 3 net credits were won by the player (764).

The GWE 712 signals ESE 710 to add 3 bullets to an ammunition clip (766). ESE 710 adds 3 bullets back to the ammo clip (EE 704) using a function 706 (768). The ammunition may be added by directly adding the ammunition to the clip or by allowing the user to find extra ammunition during game play. The GWE 712 logs the new player score (GWC 702) in the game (as a function of the successful hit on the opponent) based on the ESE 710 signaling, and the signals the ESE 710 to add 2 extra points to the player score since a jackpot has been won (770). The ESE 710 then adds 10 points to the player score (GWC 702) given the success of the hit which in this example is worth 8 points, plus the 2 extra points requested by GWE 712 (772). Note that the foregoing example is only intended to provide an illustration of how credits flow in a gambling hybrid game, but is not intended to be exhaustive and only lists only one of numerous possibilities of how a gambling hybrid game may be configured to manage its fundamental credits.

Network Based Gambling Hybrid Game

Figure 8:
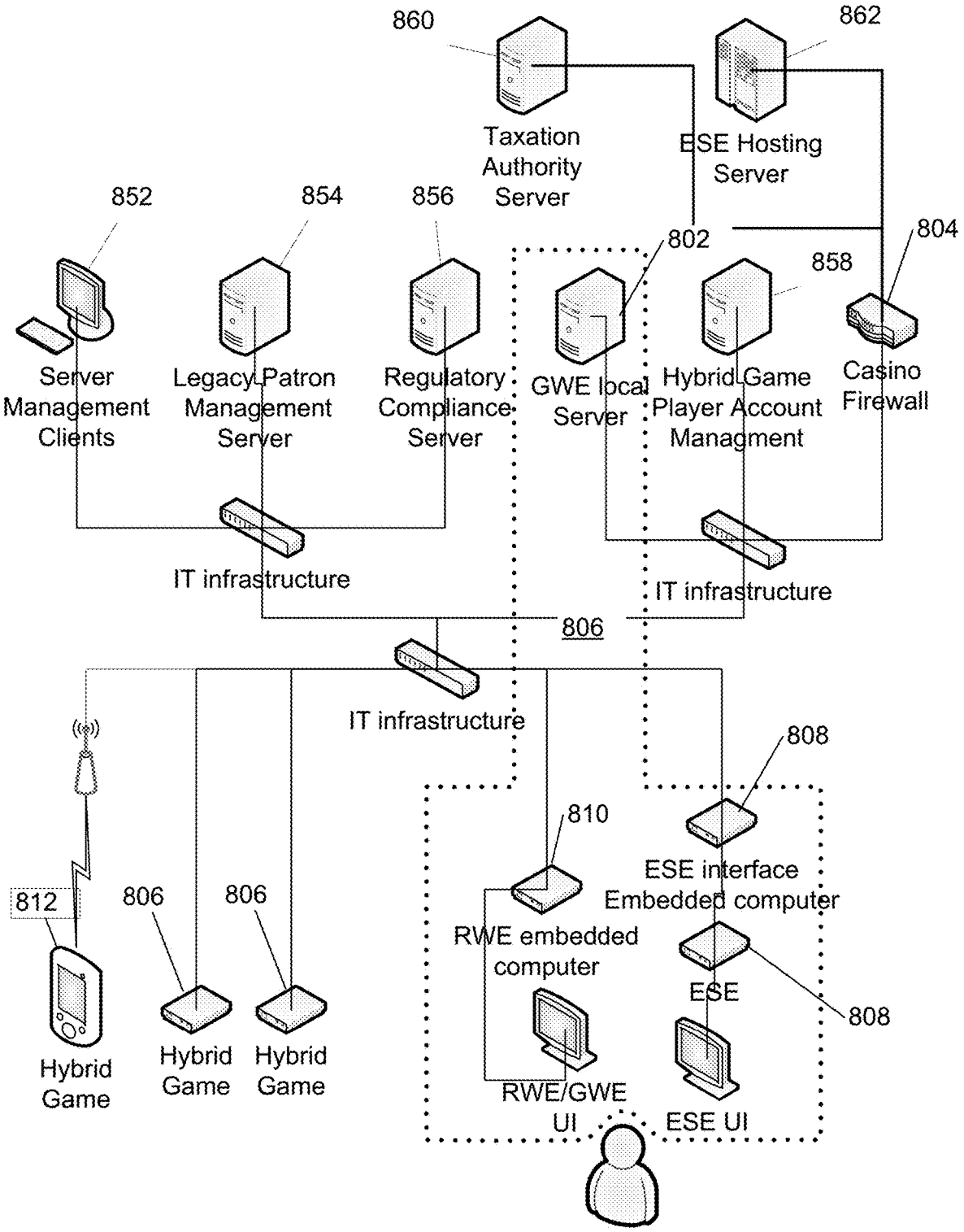
FIG. 8 illustrates a system diagram of an implementation of a network based gambling hybrid game in accordance with an embodiment of the invention.

A system diagram that illustrates an implementation of a network distributed gambling hybrid game with a GWE local server in accordance with embodiments of the invention is illustrated in FIG. 8. The system includes several gambling hybrid games 806 sharing services from the same GWE local server 802 over a network. The system includes several gambling hybrid games 806 sharing services from the same GWE local server 802 over a network. Gambling hybrid game 812 is a particular implementation where the gambling hybrid game is implemented on a mobile device connected to the network via a wireless connection. The remaining gambling hybrid games 806 can be implemented on any device, including laptops, desktop computers, mobile phones, tablets or the like over a network connection. A single gambling hybrid game 806 with a RWE 810, ESE 808 and GWE 802 is enclosed within a dotted line. A number of other peripheral systems, such as , but not limited to, legacy patron management server 852, client management server 854, regulatory compliance server 856, and hybrid game player account management server 858 can also interface with the game object gambling hybrid games over a network within an operator's firewall 804. Other servers can reside outside the bounds of a network within an operator's firewall 804 to provide additional services for network connected game object gambling hybrid games. Examples of such servers, include, but are not limited to taxation authority server 860 and ESE hosting server 862. One skilled in the art will recognize that although these systems are represented as one server that one or more connected servers or other processing systems may provide the same function without departing from the invention.

Figure 9:
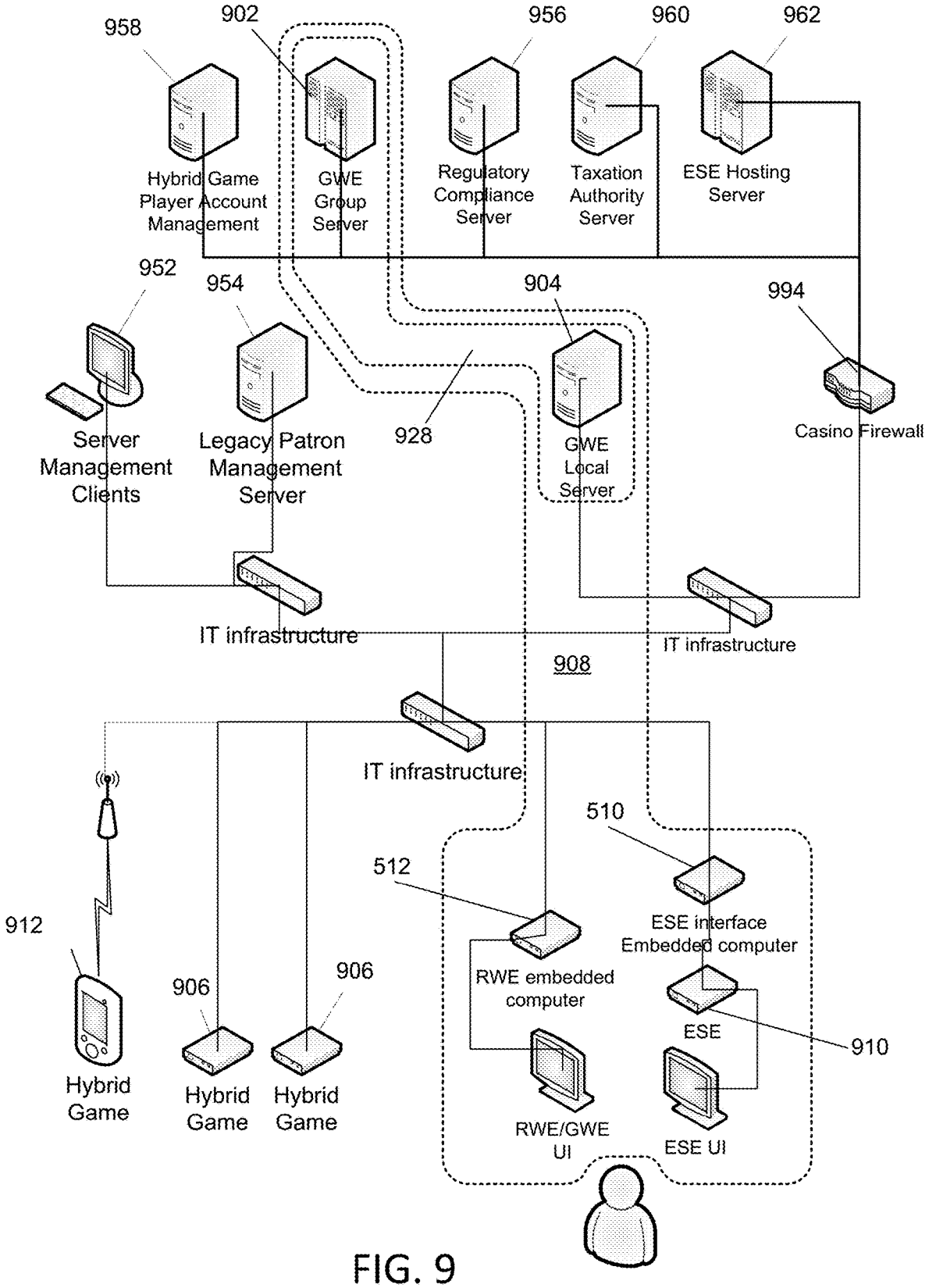
FIG. 9 illustrates a system diagram of an implementation of a network based gambling hybrid game in accordance with another embodiment of the invention.

A system diagram that illustrates an implementation of a network distributed hybrid game with a GWE local server and a GWE group server in accordance with embodiments of the invention is illustrated in FIG. 9. The system includes several gambling hybrid games 906 sharing services from the same GWE local server 928 over a network. Gambling hybrid game 912 is a particular implementation where the gambling hybrid game is implemented on a mobile device connected to the network via a wireless connection. The remaining gambling hybrid games 906 can be implemented on any device, including laptops, desktop computers, mobile phones, tablets or the like over a network connection. A single gambling hybrid game 906 with a RWE 910, ESE 908 and GWE 928 is enclosed within a dotted line. This system includes a gambling hybrid game 908 that includes a RWE 912, ESE 910 and GWE local server 904 as shown enclosed within a dotted line but where a single gambling hybrid game can call upon services from servers within an operator's firewall 906 (such as, but not limited to, a GWE local server 904) as well as beyond an operator's firewall 906 (such as, but not limited to, a GWE group server 902). The GWE group server 902 can coordinate multiple gambling hybrid games from across a network that spans beyond an operator's firewall 906. A GWE server system 918 can include multiple GWE servers, such as, but not limited to, a GWE local server 904 and a GWE group server 902. Multiple network connected hybrid games 906 can be connected to various servers to call upon services that enable the execution of the hybrid game. These servers include but are not limited to client management server 952 and legacy patron management server 954 within the casino firewall 906; and regulatory compliance server 956, hybrid game account management server 958, taxation authority server 960 and ESE hosting server 962 outside the casino firewall 906. One skilled in the art will recognize that servers may be single servers or a group of servers and processing systems providing the services without departing from the invention; and that the servers described may be within or outside of casino firewall 906 without departing from the invention.

Figure 10:
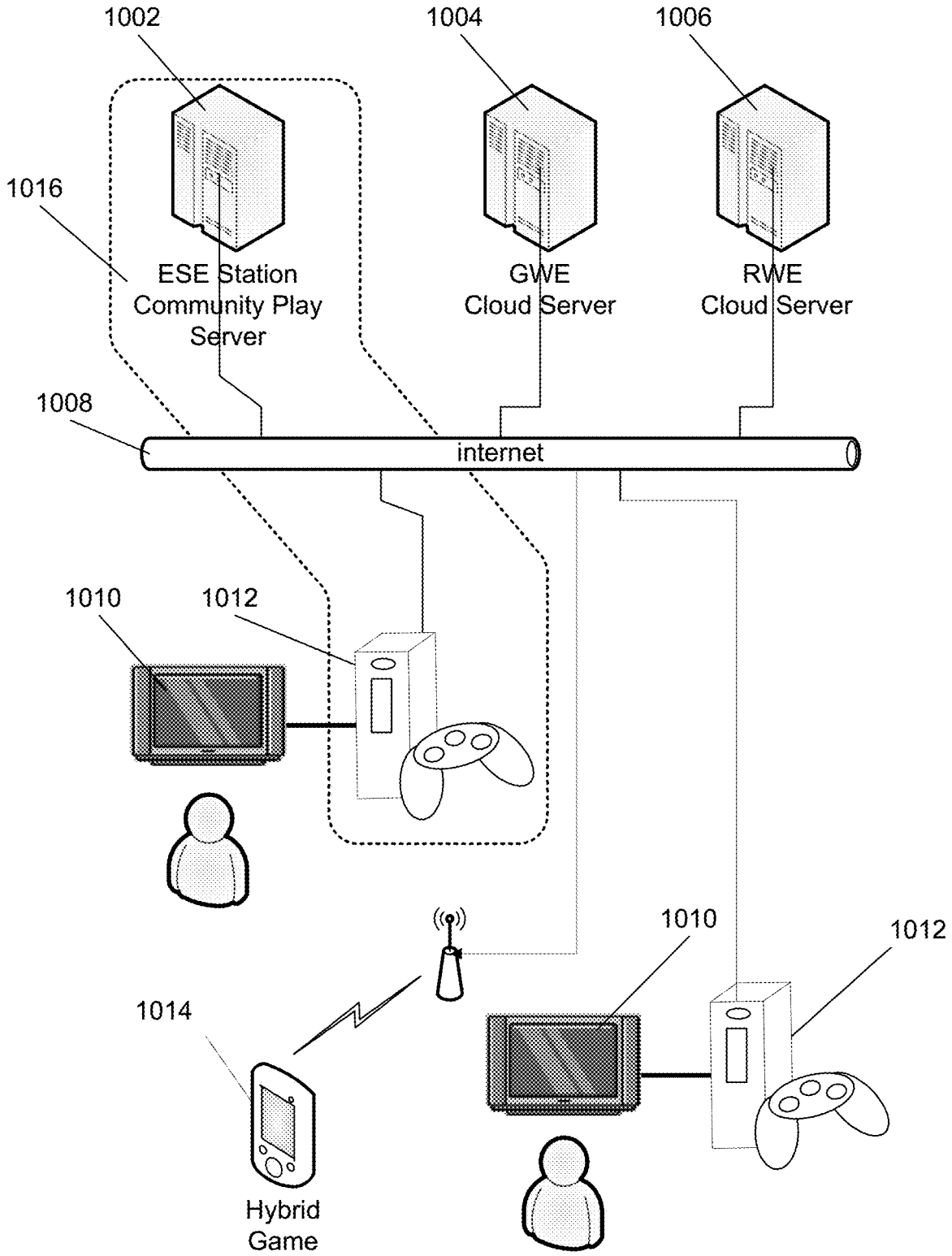
FIG. 10 illustrates a system diagram of an implementation of an Internet based gambling hybrid game in accordance with an embodiment of the invention.

A system diagram that illustrates an implementation of network distributed hybrid games over the Internet in accordance with an embodiment of the invention is illustrated in FIG. 10. The system includes an ESE server 1002, GWE server 1004 and RWE server 1006 that each connect to a user interface 1010 (such as, but not limited to, a television screen, computer terminal, tablet, touchscreen or PDA) of game object gambling hybrid games over the Internet 1008. Each gambling hybrid game includes a local ESE 1012 (such as, but not limited to, a video game console or a gaming computer system) that interfaces with a remote ESE server 1002. Processes performed by an ESE 1016 services can be performed in multiple locations, such as, but not limited to, remotely on an ESE server 1002 and locally on a local ESE 1012. In addition, a gambling hybrid game may include a Personal Digital Assistant (PDA) 1014 or other type of mobile computing device game coupled to the ESE hosting server 1002, thus providing the opportunity for a player to play a hybrid game on the PDA through a mobile phone or data network.

There are many possible permutations of the architecture of systems for providing a gambling hybrid game in accordance with embodiments of the invention. FIGS. 7-10 show only three possible permutations and are provided as examples which are not intended to suggest limitations to the forms of the architecture. Other permutations might include a version where the entire gambling hybrid game is in the cloud with only a client running on player terminal within the bounds of the casino, or a permutation where the RWE and GWE are casino bound and the ESE exists in the cloud, accessed by a client running on a terminal in the casino.

Processing Apparatuses

Figure 11:
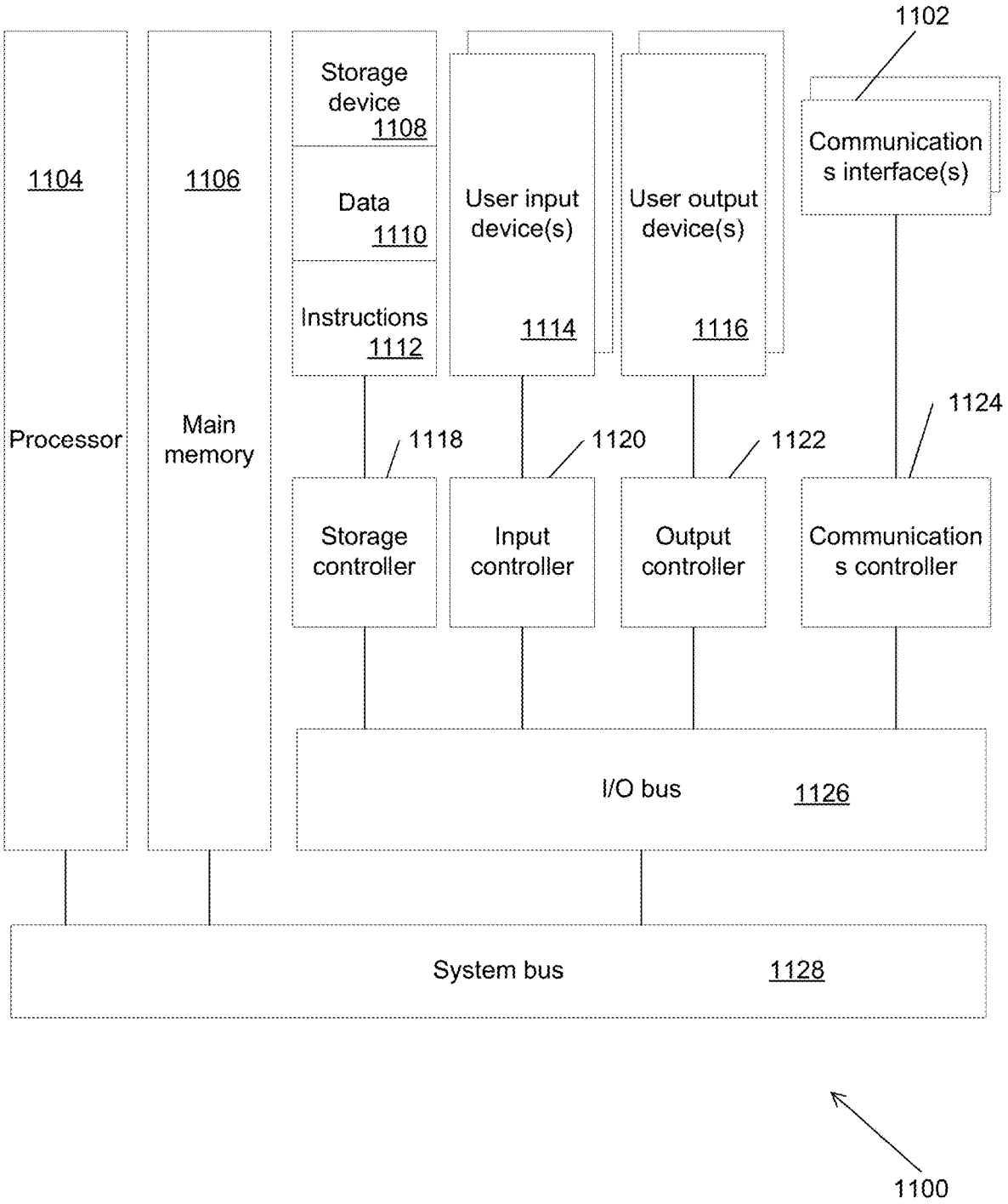
FIG. 11 illustrates a block diagram of components of a device implementing a gambling hybrid game in accordance with an embodiment of the invention.

Any of a variety of processing apparatuses can host various components of a gambling hybrid game in accordance with embodiments of the invention. In accordance with embodiments of the invention, these processing apparatuses can include, but are not limited to, a gaming machine, a general purpose computer, a computing device and/or a controller. A processing apparatus that is constructed to implement a gambling hybrid game in accordance with embodiments of the invention is illustrated in FIG. 11. In the processing apparatus 1100, a processor 1104 is coupled to a memory 1106 by a bus 1128. The processor 1104 is also coupled to non-transitory processor-readable storage media, such as a storage device 1108 that stores processor-executable instructions 1112 and data 1110 through the system bus 1128 to an I/O bus 1126 through a storage controller 1118. The processor 1104 is also coupled to one or more interfaces that can be used to connect the processor to other processing apparatuses as well as networks as described herein. The processor 1104 is also coupled via the bus to user input devices 1114, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1104 is connected to these user input devices 1114 through the system bus 1128, to the I/O bus 1126 and through the input controller 1120. The processor 1104 is also coupled via the bus to user output devices 1116 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1104 is coupled to tactile output devices like vibrators, and/or manipulators. The processor 1104 is connected to output devices from the system bus 1128 to the I/O bus 1126 and through the output controller 1122. The processor 1104 can also be connected to a communications interface 1102 from the system bus 1128 to the I/O bus 1126 through a communications controller 1124.

In accordance with various embodiments, a processor 1104 can load instructions and data from the storage device into the memory 1106. The processor 1104 can also execute instructions that operate on the data to implement various aspects and features of the components of a gambling hybrid game. The processor 1104 can utilize various input and output devices in accordance with the instructions and the data in order to create and operate user interfaces for players or operators of a gambling hybrid game(such as but not limited to a casino that hosts the gambling hybrid game).

Although the processing apparatus 1100 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 1104 through one of the interfaces or over a network. Furthermore, any of the user input devices or user output devices can be coupled to the processor 1104 via one of the interfaces or over a network. In addition, although a single processor 1104 is described, those skilled in the art will understand that the processor 1104 can be a controller or other computing device or a separate computer as well as be composed of multiple processors or computing devices.

Gambling Hybrid Game with Omniscience Mode

Figure 12:
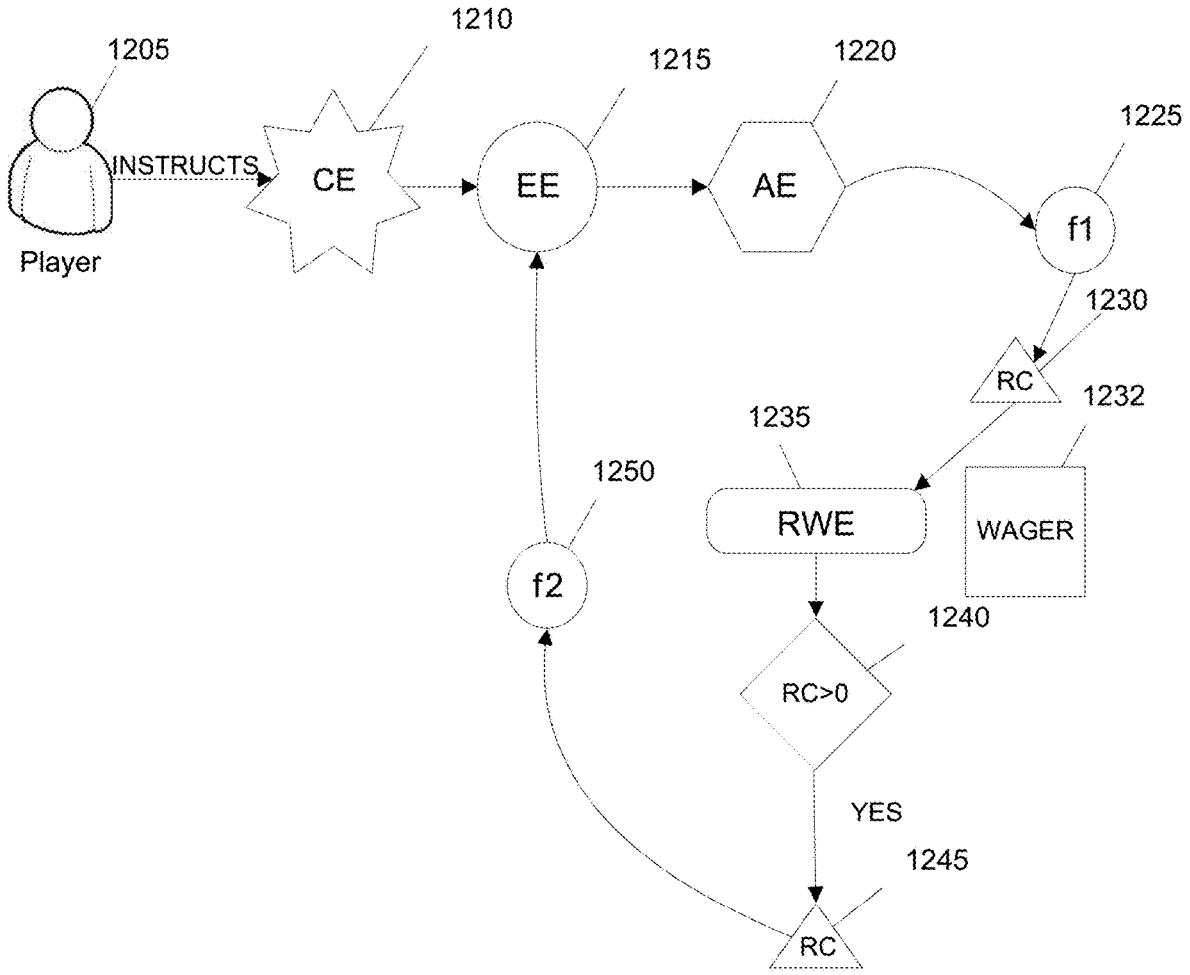
FIG. 12 illustrates a conceptual diagram of a single player interacting with a gambling hybrid game in accordance with embodiments of the invention.

In accordance with many embodiments of the invention, a gambling hybrid game allows a player to make wagers on propositions of a gambling event that occurs during play of an entertainment game. A conceptual diagram of operation of a gambling hybrid game interacting with a single player and providing a gambling event in accordance with embodiments of the invention is shown in FIG. 12. In FIG. 12, a player 1205 enters an input directing a controllable element 1210 in an entertainment game. An Entertainment Engine (EE) 1215 receives the instruction and determines the proper Action Event (AE) 1220 that is requested by the instructions. For purposes of this discussion is an AE is an event that is caused by the instruction and may include, but is not limited to, a character performing a specific action; or a modification of the inventory of the character or another game element. The action event 1220 is provided to a function 1225, f1, that determines the AE triggers a gambling event. A gambling event is event that includes probabilities that a certain outcome will result. A proposition of a gambling event is a bet that a certain outcome will occur. A wager then is an amount based on a payout of the proposition as to whether or not the outcome will occur. The gambling event includes a wager 1232 of Real World Credits (RWC or RC) 1230. The wager may be input by the user or be based upon the gambling event occurring. The RWE 1235 is informed of the gambling event and determines the outcome 1245 of the gambling event and the wager (1240). The outcome of the gambling event is provided to a function 1250 f2. The f2 1250 incorporates the results into game play parameters and provides the game play parameters to EE 1215 for incorporation into the entertainment game. Other aspects and embodiments disclosed previously are incorporated by reference herein. For the purposes of this disclosure, this construct will represent the base case of a player that is engaged in single-player play against himself, time, a computer opponent, etc.

In accordance with some embodiments of the invention, an omniscience mode of play in the gambling hybrid game is provided. In an omniscience mode, the player is provided some game related information that is not available to the player in conventional game play in or out of context of the gambling hybrid game. The information may be given in anticipation of wagering on a proposition of a gambling event or may be given as a result of a gambling event. The provided information, "Target Information", essentially provides the player with intelligence about the state of game play that provides a measure of omniscience to the player. A non-exhaustive list of exemplary Target Information follows: In Battleship, a player may be exposed to a view of a portion of his opponents board, either permanently, or temporarily; In Scrabble, a player may be exposed to some or all of his opponent(s) tiles, for a fixed period of time; In a gambling hybrid game version of World of Tanks, a multiplayer tank battle game, the player may receive a radio communication from his "General" indicating that "intelligence indicates the enemy's tanks are proceeding due east along the river bank"; In a game of Texas Hold 'Em, a player may be given a view as to the next card in the dealer's deck, the cards in the discard pile, and/or one or more of the cards held by his opponent(s).

In accordance with several embodiments, the player may be exposed to the target information as a result of the outcome of a gambling game, dubbed an Omniscience Gambling Proposition (OGP). The GWE exposes the player to this proposition when conditions in the entertainment game warrant and may also take into account other factors, such as Casino policy, data derived from the player's account, player preferences, the number of omniscience gambling propositions offered and/or accepted by the player during this game session or a given period of time, etc. A process of providing target information to a player during game play of a gambling hybrid game having an omniscience mode in accordance with embodiments of the invention is shown in FIG. 13.

Figure 13:
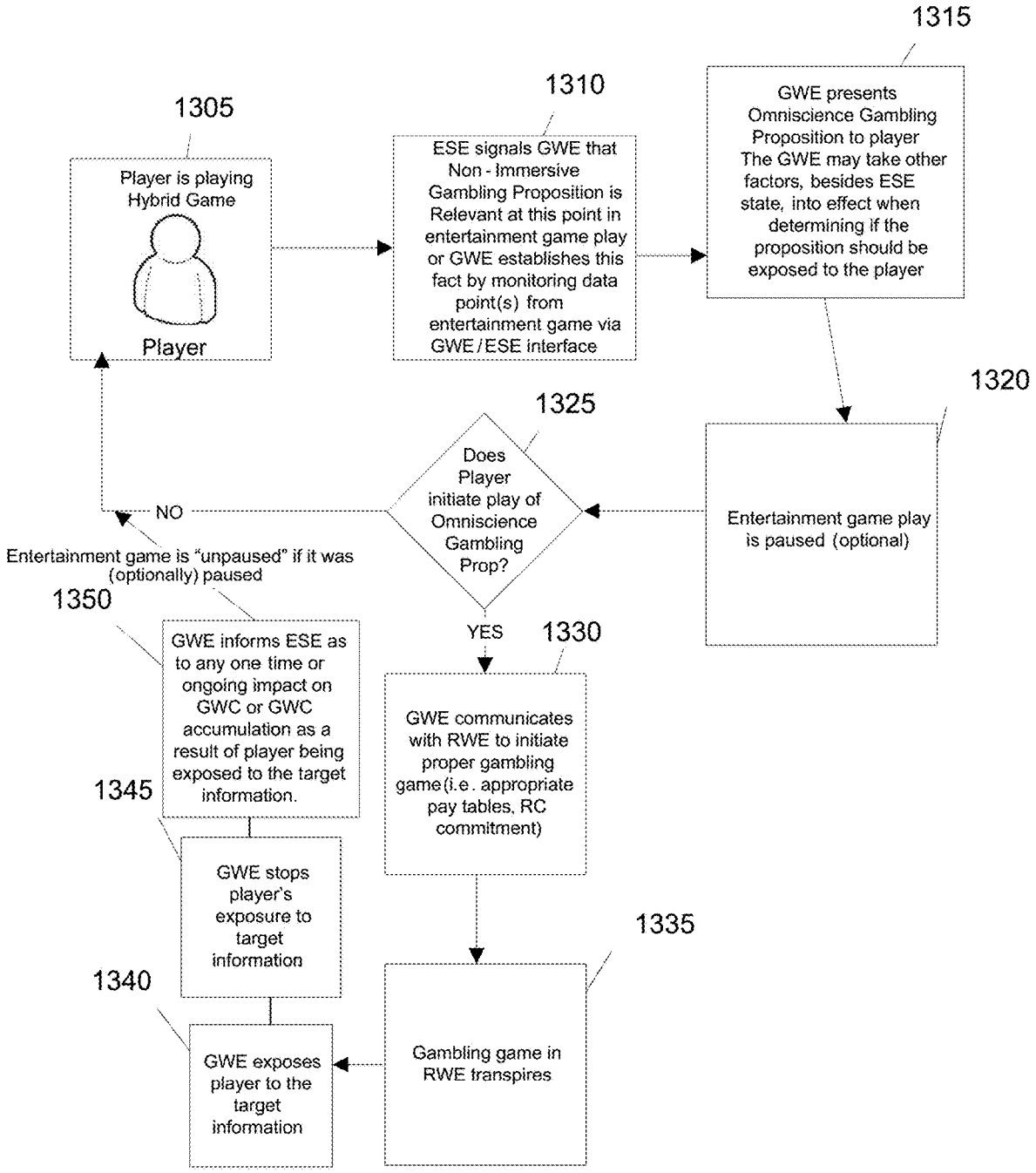
FIG. 13 illustrates a conceptual diagram of an omniscience mode of a gambling hybrid game in accordance with embodiments of the invention.

In the process shown in FIG. 13, a player is playing a gambling hybrid game (1305). During the of the gambling hybrid game, the ESE signals the GWE that a non-immersive gambling proposition is relevant at this point in entertainment game play or GWE establishes this fact by monitoring data point(s) from entertainment game via the GWE/ESE interface (1310). In response, the GWE presents an OGP to player via the ESE (1315). The GWE may take other factors, besides ESE state, into effect when determining if the proposition should be exposed to the player. Furthermore, the player may be required or given the option of placing an RWC wager on the OGP. The OGP may be exposed to the player in a general or highly specific way (e.g. in BATTLESHIP: "if you win the bet you will gain information about your opponent's board" or "if you win the bet you will see the contents of a randomly selected 2×2 grid" on your opponent's board"). To present and perform the OGP, the ESE may optionally pause game play of the gambling hybrid game (1320). The ESE then awaits an input indicating that the player initiates the OGP. Other game play continues (1305).

If the OGP is initiated, GWE communicates with RWE to initiate the proper gambling event (i.e. appropriate pay tables, RC commitment) (1330). The RWE resolves the OGP and any wager based on the gambling event performed. The results are then returned by the RWE to the GWE (1335). If the wager of the player is successful, the GWE exposes the player to the target information via the ESE (1340) and stops exposure after a predetermined amount of time (1345). Furthermore, the wager of RWC on the OGP is managed by the RWE and the GWE is updated accordingly. With regards to the OGP, the Target Information provided to the player can be of a singular nature (i.e. there is only one piece of Target Information corresponding to a singular or plurality of winning gambling outcomes), or it can vary as a function of the nature of the gambling win (i.e. there are multiple variants of the Target Information as a function of the magnitude of the gambling win, if any). For example, an OGP for Battleship could provide the following target information for 30 seconds of real time in response to the following RC wins in the context of a 1 RC bet. The following table show an amount of target information provided on the basis of the amount of RWC wagered for a Battleship game:

| Amount won | Target Information |
|---|---|
| <= 0 | None |
| 1 | The contents of a single square on opponent's board |
| 2 | The contents of a 2x2 grid on the opponent's board |
| | The contents of a 3x3 grid on the opponent's board |

The RC won and the target information gained do not need to directly correlate, although it may. A player may win Target Information as the result of a gambling game win, but not receive RC or vice versa.

The GWE then determines any one-time or ongoing impact of exposure of the target information to the player (1350). This may include, but is not limited to, GWC or GWC accumulation as a result of player being exposed to the target information. If the gameplay was paused, gameplay is re-started. Game play is then resumed (1305).

One skilled in the art will recognize that the presentation of the OGP to the player, and/or the presentation of the gambling game results and Target Information (if any) can be displayed to the player on the same user interface on which the entertainment game and other information is provided, and/or a dedicated interface (i.e. OGP UI). The dedicated interface may be integrated with a single Hybrid Game, or may be a shared interface across multiple games. In a BATTLESHIP game, for example, main Hybrid Game play takes place on a flat panel display with touch screen. A second flat panel display sits above this, and is designed so that it takes on the appearance of a radar screen, with a green radar sweep. When inactive the radar sweep appears to be affected by clouds, it does not show any information usable to the player. When an OGP is presented to the player it is displayed on this screen, and is accompanied by a "horn" sound to alert the player to the OGP's availability. The OGP may persist indefinitely or for a set amount of time, a set amount of rounds of the game, or other metric established as a function of the specific game design and/or casino choice. If the player accepts the OGP (via the secondary screen's touch screen), and a winning gambling game results, the radar sweep will show a part of the opponent's grid in accord with the aforementioned table.

In accordance with some embodiments, the player may be exposed to target information as a result of directly purchasing "hints" or access to that information, rather than dependent on gambling game results. A player may purchase target information in advance and chose when to use that access, they may be prompted by the game system to access target information, or the game may determine when to display the target information. In accordance with some embodiments providing head-to-head competition, the gambling hybrid game system may inform opponent(s) when the player gains target information. This information provided to opponents may vary in detail. For example, in a gambling hybrid game of Texas Hold 'em, the opponent may be informed that the player has seen a card in his hand, or may be informed the specific card that has been exposed. In accordance with some of these embodiments, the opponent may be given the opportunity to pay or bet to block access to target information; pay or bet to get access to the same target information; pay or bet to obfuscate specific information; or pay or bet to know what target information the player actually has. For example, in the above mentioned game of Texas Hold 'em, an opponent may pay or bet for the chance to block all access to his cards, or to obfuscate a specific card in his hand.

Figure 14:
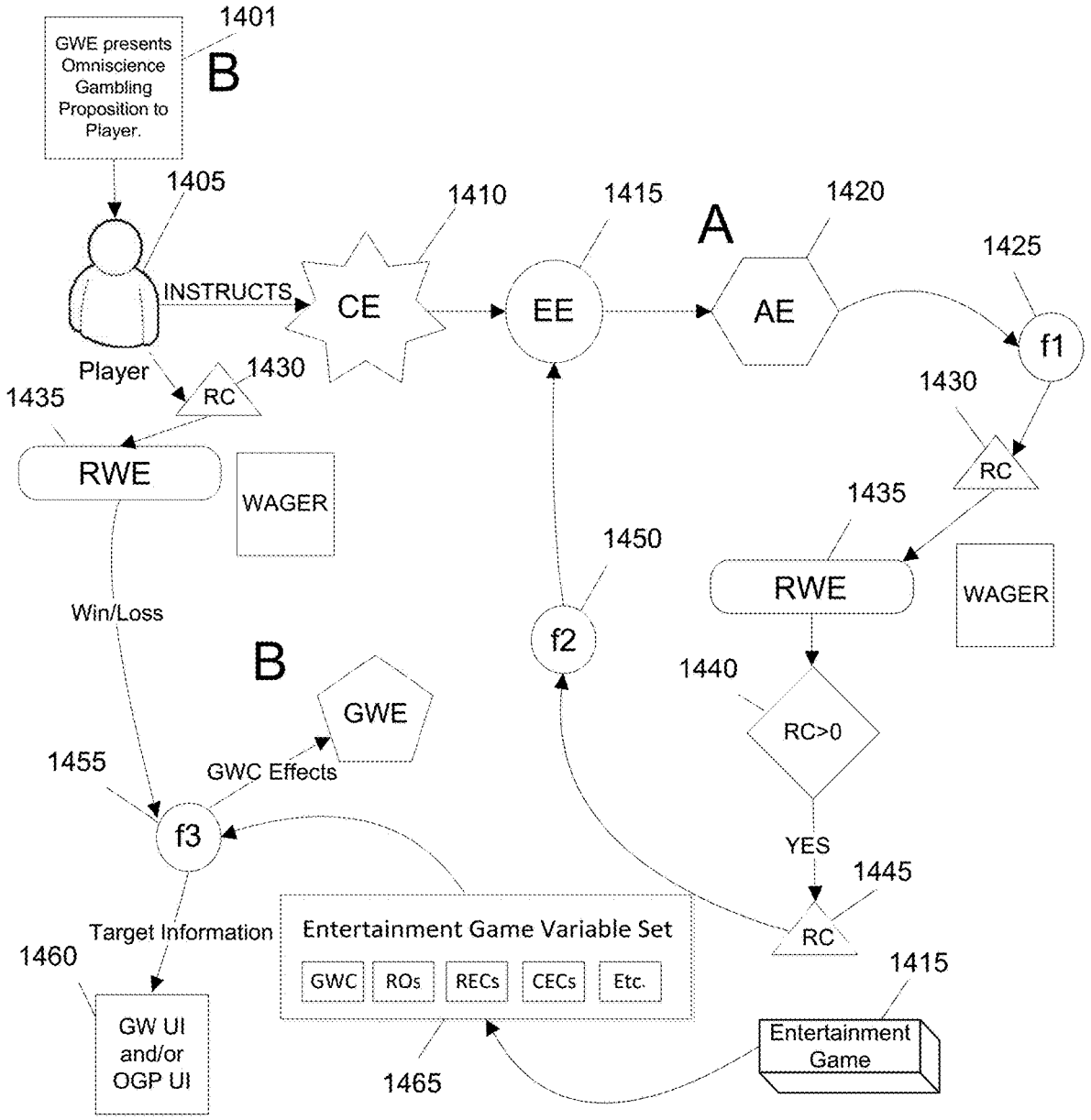
FIG. 14 illustrates a conceptual diagram of a single player interacting with a gambling hybrid game in both an immersive mode and an omniscience mode in in accordance with embodiments of the invention.
Figure 15:
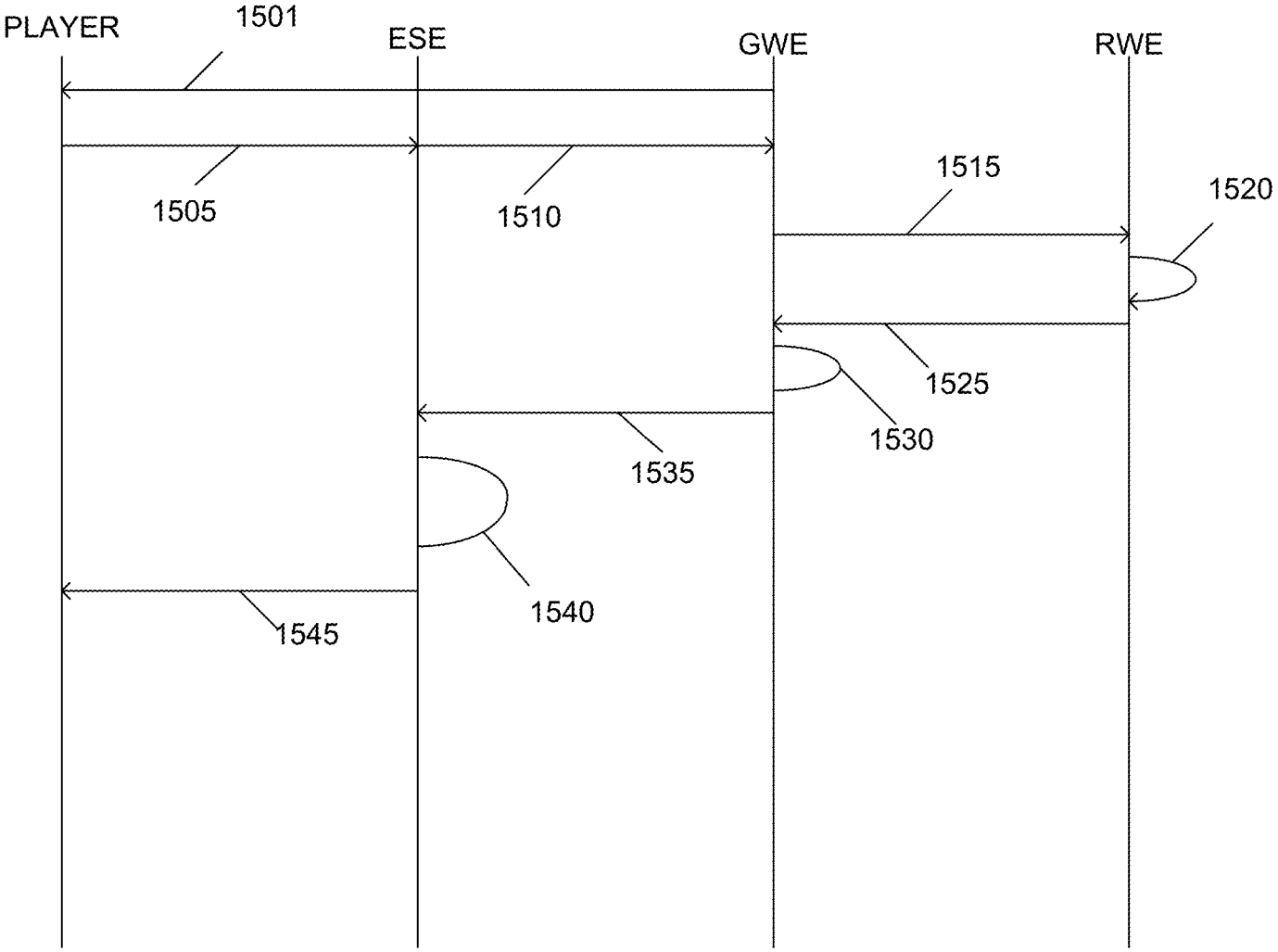
FIG. 15 illustrates a timing diagram of information passed between components of a system providing a gambling hybrid game having an omniscience mode in accordance with embodiments of the invention.

A comparison of the handling of gambling events in a conventional or immersive mode; and an omniscience mode in accordance with embodiments of the invention is shown in FIG. 14.

The process for handling a gambling event in accordance with embodiments of the invention proceeds in the manner. A player 1405 enters an input directing a character element 1410 in an entertainment game. An Entertainment Engine (EE) 1415 receives the instruction and determines the proper Action Event (AE) 1420 that is requested by the instructions. For purposes of this discussion is an AE is an event that is caused by the instruction and may include, but is not limited to, a character performing a specific action; or a modification of the inventory of the character or another game element. The action event 1420 is provided to a function 1425, f1, that determines the AE triggers a gambling event. A gambling event is event that includes probabilities that an certain outcome will result. A proposition of a gambling event is a bet that a certain outcome will occur. A wager then is an amount based on a payout of the proposition as to whether or not the outcome will occur. The gambling event includes a wager of Real World Credits (RWC or RC) 1430. The wager may be input by the user or be based upon the gambling event occurring. The RWE 1435 is informed of the gambling event and determines the outcome 1445 of the gambling event and the wager (1440). The outcome of the gambling event is provided to a function 1450 f2, that incorporates the results into game play parameters and provides the game play parameters to EE 1415 for incorporation into the entertainment game.

In a gambling hybrid game including an omniscience most, an Omniscience Gambling Proposition is differentiated from a gambling event in an immersive mode of the gambling hybrid Game because in the immersive mode, a gambling is initiated by conventional in-game actions associated with entertainment game play. In the omniscience mode, the player him/herself is flagged to evaluate and potentially participate in a gambling proposition that provides a closed loop to the entertainment game, but operates outside conventional entertainment game play, and provides the loop through the player, by virtue of providing player with information that impacts their playing of the game.

The following process is the process for providing OGP in accordance with embodiments of the invention. The GWE presents an OGP to the player 1405 during game play via the ESE (1401). The player accepts the OGP and places a RC wager 1430. The OGP including RC wager 1430 are provided to RWE 1435 by the GWE. The RWE 1435 determines the result of the gambling event and updates the RC account of a player based on the result of any wagers and provides the results of the gambling event to a function (f3) 1455 in the GWE. The f3 1455 then determines the target information to provide and GWC effects of the results of the OGP. In accordance with embodiments of the invention, the f3 1455 takes into account the RC win achieved by the player as a function of playing the gambling event related to the OGP, and along with inputs from the ESE (i.e. entertainment game variables 1465) fashions an output that is displayed to the player through a user interface. The f3 1455 also informs the ESE as to any one-time or ongoing GWC modifications as a result of exposing the player to any Target Information. For example, in BATTLESHIP, a player may not accumulate any GWC for "hits" he subsequently achieves in that portion of her opponent's board exposed to the player as part of the Target Information. As such the player can still be advantaged as regards winning the game, but the amount of GWC accumulated during game play will be reduced relative to not having been shown the Target Information and having made the same sequence of moves otherwise.

Gambling Hybrid Game Providing an Omniscience Mode

Figure 16:
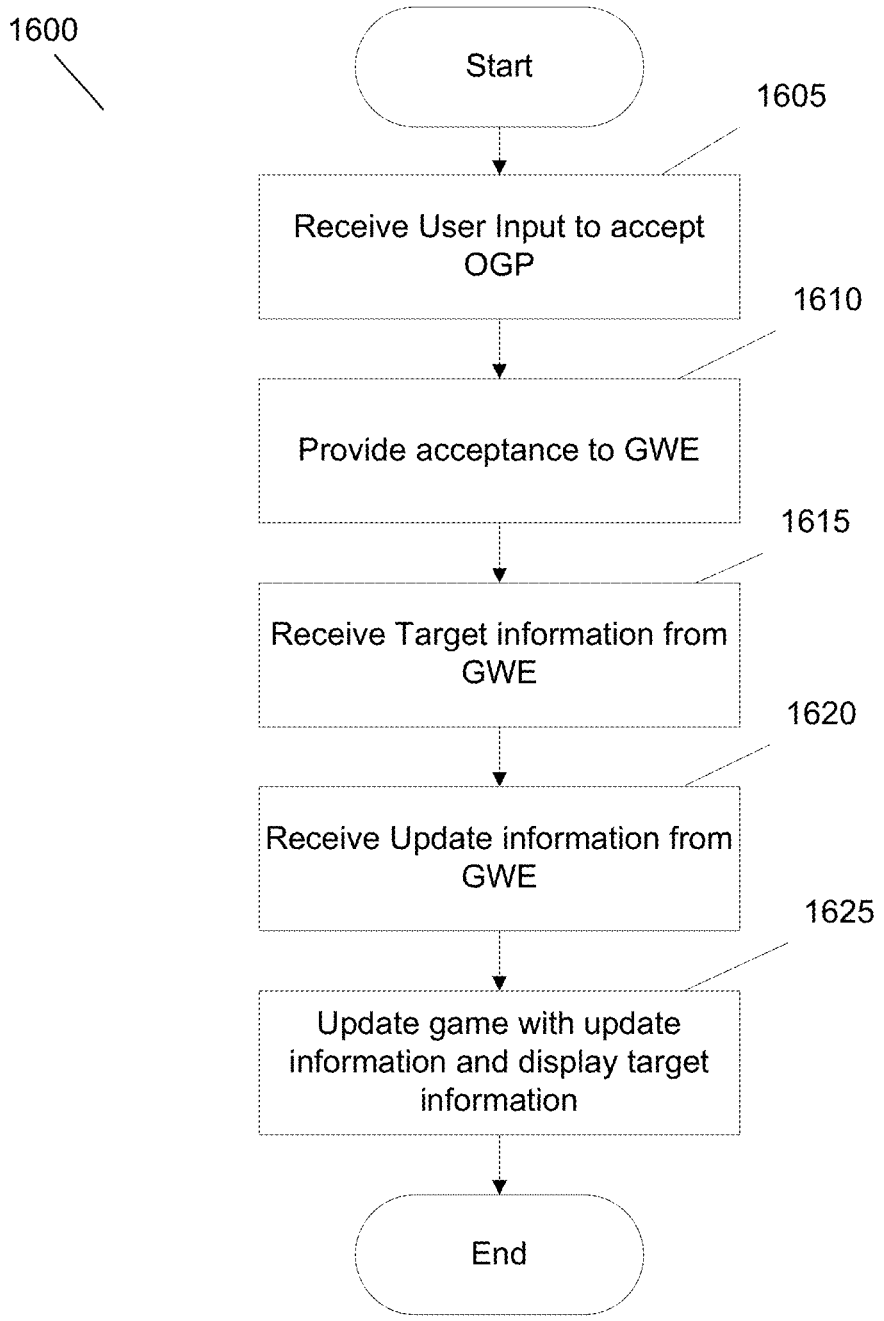
FIG. 16 illustrates a flow diagram of a process performed by an Entertainment System Engine to provide a gambling hybrid game having an omniscience mode in accordance with embodiments of the invention.
Figure 17:
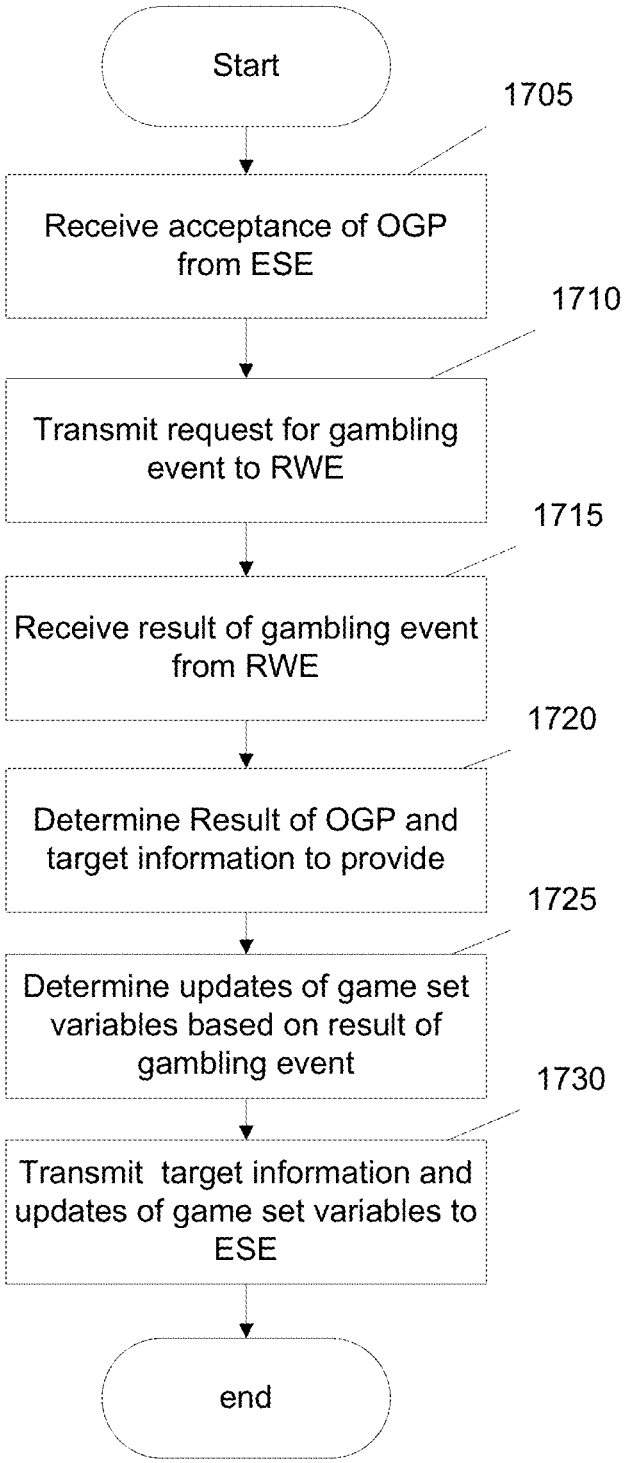
FIG. 17 illustrates a flow diagram of a process performed by a Game World Engine to provide a gambling hybrid game having an omniscience mode in accordance with embodiments of the invention.
Figure 18:
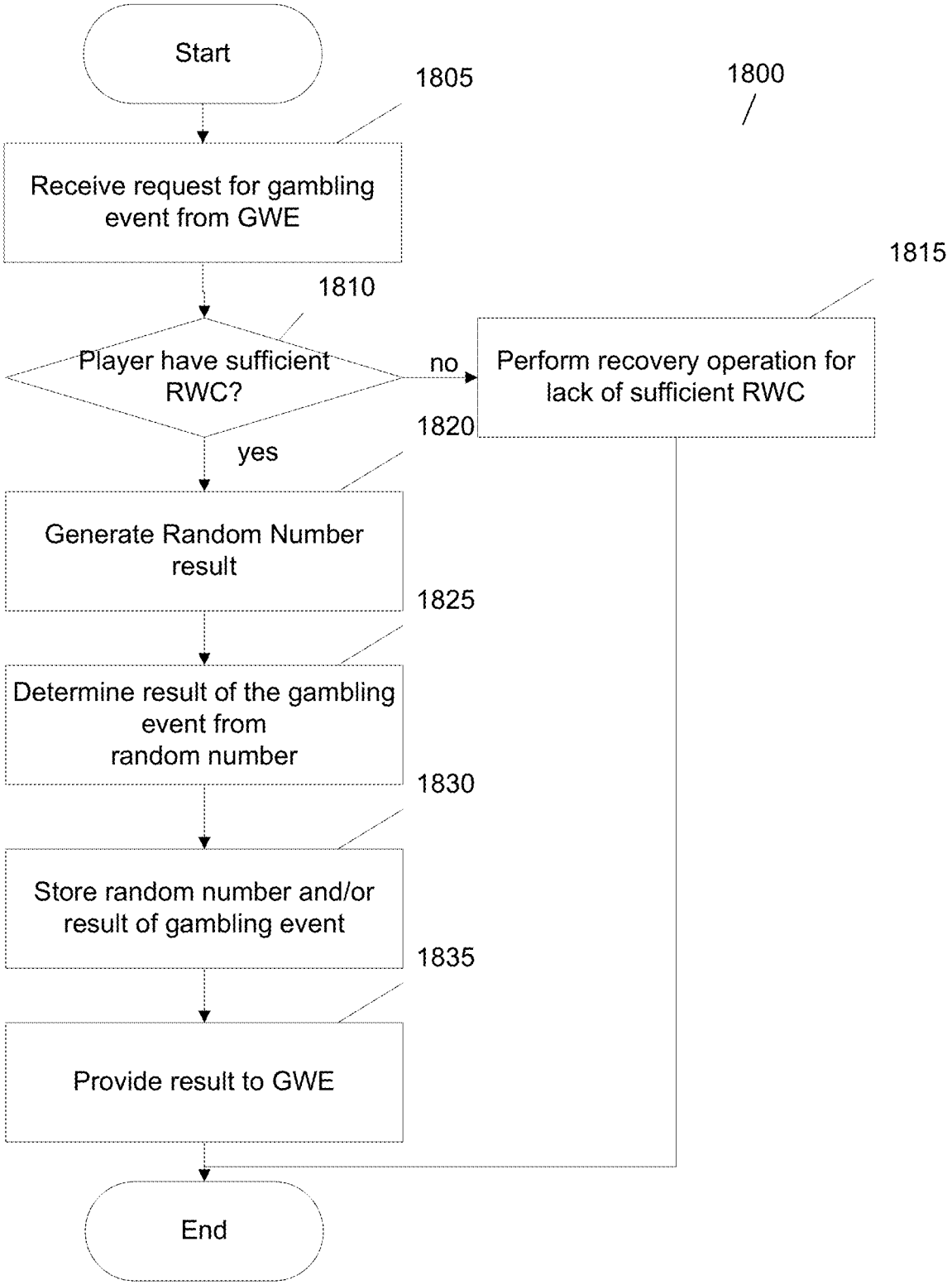
FIG. 18 illustrates a flow diagram of a process performed by Real World Engine to provide a gambling hybrid game having coincident gambling and game events in accordance with embodiments of the invention.

A system that provides a gambling hybrid game having an omniscience mode in accordance with embodiments of the invention is shown in FIGS. 15-18. A timing diagram of the information passed between various components of the system to provide an omniscience mode is shown in FIG. 18. The process begins when the GWE provides present an OGP to the player via the ESE when the ESE receives an input (1505) accepting the OGP and provides the acceptance to the GWE (1510). The GWE then determines a gambling event associated with the OGP and sends a request for the gambling event the RWE (1515). The RWE then determines the result of the gambling event (1520). The result of the gambling event is then provided by the RWE to GWE (1525). The GWE then uses a function, f5, to determine how the result of the gambling event affects the OGP and determines the target information to provide the user (1530). Additionally, the GWE may determine how the result of the gambling event affects set of game variables (1130). The determined target information and any required updates of the game variables in the set of game variables are then provided by the GWE to the ESE (1535). The ESE displays the target information to the player (1545). Additionally, the ESE may update the set of game variables according to the received updates (1540) and present the updated game to the user.

A process for receiving the input from the player and presenting target information based on the results of an OGP in accordance with embodiments of the invention is shown in FIG. 16. In process 1600, the ESE receives the input from the player accepting the OGP (1605). The acceptance is provided by the ESE to the GWE (1610). After the OGP is resolved by the GWE, the ESE receives target information from the GWE (1615). The ESE may also receive update information for a set of game variables based on the OGP (1620) The target information is then displayed for the player by the ESE and the entertainment game is updated with any update information received accordingly (1625).

A process for providing an OGP performed by a GWE in accordance with embodiments of the invention is shown in FIG. 17. In process 1700, the GWE receives of the OGP from the ESE (1705). The GWE then requests the gambling event associated with the OGP be performed by the RWE (1710). The request may include the amount of RWC wager on the proposition. The GWE then receives the results of the gambling event from the RWC (1715). The results provided to the GWE may also include RNG results and other information. The GWE may store the results and/or other information received in a database for use in determination of future gambling events. The results of the gambling events are used by the GWE to determine the results of the OGP and, in turn, the target information to be provided based upon the results of the OGP (1720). The results of the gambling events may also be used by the GWE to determine updates of the game variables (1725). The determined target information and updates are transmitted by the GWE to the ESE (1730).

A process performed by the RWE to determine the results of the gambling events and provide the results to the GWE in accordance with embodiments of the invention is shown in FIG. 18. In process 1800, the RWE receives a request for a gambling event from the GWE (1805). The request may include amount wagered, an indication of a proper RNG to use, and an indication of the pay tables to use to resolve the wager. The RWE determines whether the user has sufficient RWC available to cover the wager (1810). If the client does not have sufficient RWC to cover the wager, the RWE performs a recovery operation (1815). The recovery operation may prevent the wager from occurring or may allow the user to supply the necessary funds to cover the wager. If the user has sufficient RWC, the RWE generates a random number result using the proper RNG (1820). The random number result is then used to determine the results of the gambling event and do all other appropriate operations for updating the RWC available to the user (1825). The RWE may store the result and/or other information about the result, including the random number result, in a database for future use (1830). The RWE also provides the result of the gambling event to the GWE (1835).

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. An electromechanical gaming machine for execution of a hybrid game having an entertainment game and a gambling game, the electromechanical gaming machine comprising:

a user input device;

a user output device;

an entertainment engine connected to a game world engine, wherein the entertainment engine is configured to:

execute the entertainment game;

provide an invitation to accept an omniscience gambling proposition wherein the omniscience gambling proposition provides information about an entertainment game state; and receive input from a user to accept the omniscience gambling proposition via the user input device;

a real world engine connected to the game world engine, wherein the real world engine is configured to:

receive from the game world engine, a request to determine a result of a gambling event associated with the omniscience gambling proposition;

determine the result of the gambling event using a random number generator and a pay-table; and distribute to the game world engine, the results of the gambling event; and the game world engine connected to the entertainment engine, wherein the game world engine is configured to:

receive the acceptance of the omniscience gambling proposition from the entertainment engine;

request the result of the gambling event from the real world engine;

receive the result of the gambling event from the real world engine;

determine the result of the omniscience gambling proposition including the information to provide to the entertainment engine based on the results of the omniscience gambling proposition; and distribute the information and timing instructions to the entertainment engine, wherein the entertainment engine is further configured to: receive the information from the game world engine; determine the entertainment game state associated with the information; display the entertainment game state to the user through a user interface using the user output device based on the timing instructions.

2. The electromechanical gaming machine for execution of a hybrid game having an entertainment game and a gambling game of claim 1, wherein the game world engine is further configured to determine changes to a set of entertainment game variables based on the result of the gambling event.

3. The electromechanical gaming machine for execution of a hybrid game having an entertainment game and a gambling game of claim 2, wherein the game world engine is further configured to provide the changes to the set of game variables to the entertainment engine, and wherein the entertainment engine is further configured to receive the changes to the set of game variables from the game world engine and incorporate the changes in the set of game variables into the entertainment game.

4. The electromechanical gaming machine for execution of a hybrid game having an entertainment game and a gambling game of claim 1, wherein the game world engine is further configured to initiate the entertainment engine to provide the invitation to participate in the omniscience gambling event to the user.

5. The electromechanical gaming machine for execution of a hybrid game having an entertainment game and a gambling game of claim 1, wherein the real world engine is further configured to:

resolve a wager of real world credits on the gambling event based upon the result of the gambling event; and update an real world credit account associated according to the result of the wager.

6. The electromechanical gaming machine for execution of a hybrid game having an entertainment game and a gambling game of claim 1, wherein the game world engine and the real world engine are configured from the same device.

7. The electromechanical gaming machine for execution of a hybrid game having an entertainment game and a gambling game of claim 6, wherein the game world engine is connected to the entertainment engine by a network.

8. The electromechanical gaming machine for execution of a hybrid game having an entertainment game and a gambling game of claim 1, wherein the entertainment engine and the game world engine are configured from the same device.

9. The electromechanical gaming machine for execution of a hybrid game having an entertainment game and a gambling game of claim 8 wherein the game world engine is connected to the real world engine by a network.

10. The electromechanical gaming machine for execution of a hybrid game having an entertainment game and a gambling game of claim 1, wherein the entertainment engine, the game world engine, and the real world engine are configured from the same device.

* * * * *